United States Patent [19]

Schwarz

[11] Patent Number: 4,615,681

[45] Date of Patent: Oct. 7, 1986

[54] PROGRAMMABLE, USER INTERACTIVE CIGARETTE DISPENSER AND METHOD THEREFOR

[76] Inventor: Eitan D. Schwarz, 988 Oak Dr., Glencoe, Ill. 60022

[21] Appl. No.: 707,627

[22] Filed: Mar. 4, 1985

Related U.S. Application Data

[63] Continuation-in-part of Ser. No. 540,680, Oct. 11, 1983.

[51] Int. Cl.[4] ..... G09B 19/00

[52] U.S. Cl. ..... 434/236; 131/270

[58] Field of Search ..... 131/270, 329; 434/326

[56] References Cited

U.S. PATENT DOCUMENTS

| | | | |
|---|---|---|---|
| 580,736 | 4/1897 | Smith . | |
| 2,016,534 | 10/1935 | Blackwell et al. . | |
| 2,415,911 | 2/1947 | Rubane . | |
| 2,456,963 | 12/1948 | Leatherman . | |
| 2,554,360 | 5/1951 | Davis . | |
| 2,613,527 | 10/1952 | Harris . | |
| 2,618,956 | 11/1952 | Hanna . | |
| 2,675,693 | 4/1954 | Emery . | |
| 2,681,560 | 6/1954 | Shuttleworth et al. . | |
| 2,812,851 | 11/1957 | Kinnebrew . | |
| 2,951,357 | 9/1960 | Geraghty . | |
| 2,953,280 | 9/1960 | Carboro . | |
| 3,017,763 | 1/1962 | Weil . | |
| 3,030,795 | 4/1962 | Vogt . | |
| 3,206,957 | 9/1965 | Reitzes . | |
| 3,363,439 | 1/1968 | Kende . | |
| 3,424,123 | 1/1969 | Giffard . | |
| 3,655,325 | 4/1972 | Toppel . | |
| 3,660,998 | 5/1972 | Ishijima . | |
| 3,722,742 | 3/1973 | Wertz . | |
| 3,750,435 | 8/1973 | Felkin . | |
| 3,815,780 | 6/1974 | Bauer . | |
| 3,886,953 | 6/1975 | Pope | 131/270 |
| 4,037,719 | 7/1977 | Perimutter . | |
| 4,076,118 | 2/1978 | Karlsson | 131/270 X |
| 4,084,415 | 4/1978 | Corman . | |
| 4,223,801 | 9/1980 | Carlson . | |

*Primary Examiner*—William H. Grieb

*Attorney, Agent, or Firm*—Emrich & Dithmar

[57] ABSTRACT

A cigarette dispenser provides user access to cigarettes therein only after a preset time interval to permit the user to later reconsider the decision to smoke and allow the initial urge for a cigarette to subside. A manually selected switch on the dispenser can be engaged by the user when a cigarette is desired and is coupled to and triggers a timer preset to a predetermined time interval. A switch coupled to an audio alarm prevents the dispenser from being opened prior to running and expiration of the predetermined time interval without an embarrassing, user nondefeatable sound being emitted by the dispenser. Programmable control means are provided for regulating cigarette access times, cigarette puffing delays, etc., as a function of the individual user's smoking pattern. A visual signal is provided to indicate when the predetermined time interval has expired and the dispenser may be opened without sounding the alarm. Various other timers measure a second time period during which an embarrassing alarm sounds when the lid is opened in an unauthorized manner as well as a third time period for triggering the audio alarm if the dispenser remains open beyond this third time period. Counters count the total number of times the dispenser is opened, the number of times the dispenser was not opened following countdown of the predetermined time interval, the number of times the dispenser was opened without setting or waiting for the running of the predetermined time interval, and maintain running totals of these numbers.

43 Claims, 12 Drawing Figures

PROGRAMMABLE, USER INTERACTIVE CIGARETTE DISPENSER AND METHOD THEREFOR

This is a continuation-in-part of application Ser. No. 540,680, filed Oct. 11, 1983, in the name of the present inventor for "Cigarette Dispenser."

BACKGROUND OF THE INVENTION

This invention relates generally to cigarette cases for holding a quantity of cigarettes and is particularly directed to a microcomputer controlled cigarette dispenser which constantly monitors and analyzes an individual user's smoking habits and uses a variety of clinically proven techniques to wean the smoker gradually and systematically from his smoking habit.

The physical hazards of cigarette smoking are well known and their consumption discouraged by health authorities. The reduction of cigarette smoking is desirable in itself because it is well-known that the damage due to cigarette smoking is cumulative and dose related. In addition to the danger of fire associated with smoking, medical authorities have shown beyond doubt that there is a greater incidence of heart, lung and throat ailments including cancer among smokers than among non-smokers. In addition, non-smokers who are in the vicinity of a cigarette smoker are exposed to the irritation and possible health hazard of the smoke thus produced. Furthermore, smoking can be a costly habit particularly in the case of a heavy smoker. Thus, ever increasing numbers of smokers have undertaken efforts to reduce, if not to completely stop, cigarette consumption.

Attempts at giving up the cigarette smoking habit have ranged from the use of deterrent drugs to professional counseling and even to hypnosis. These various approaches have, in general, all suffered from various shortcomings. Individual professional and group counselling have met with varying degrees of success, although the former is frequently expensive and the latter frequently inconvenient, requiring time consuming travel and attendance at meetings. In addition, mass communications campaigns sponsored by the government and various nonprofit organizations have attempted to bring the dangers of smoking to the attention of the general public with limited success. Finally, hypnosis is relied upon as an anti-smoking aid, however, its nature discourages many smokers from attempting this approach. Hypnosis and other treatment programs are episodic and not directly available to the smoker at each moment of decision to light up. Nicotine substitution by prescription by a physician is costly and has undesirable side effects.

Other anti-smoking efforts have centered not so much on the individual, but rather on a device for discouraging or inhibiting smoking. Such devices frequently include a cigarette container having a time controlled locking mechanism which provides the smoker with access to the cigarettes only at predetermined times. The use of such devices is based upon the theory that the cigarette smoking habit can best be terminated, or at least controlled, by a gradual withdrawal rather than completely stopping all at once. According to this approach, the craving for cigarettes will gradually subside until it is lost completely. This type of device, however, confronts the smoker with a cigarette abstinence situation, at least temporarily, and frequently proves too much, particularly for the high rate smoker who then circumvents the system by acquiring another source of cigarettes. Thus, after an initial period of use, this type of device is typically discarded by the smoker who is unable to accept and deal with the complete denial, albeit temporary in nature, of access to a cigarette.

On the other hand, however, if a smoker continues to have access to his cigarettes, he will be less likely to bypass the device and rely upon an alternate source of cigarettes. To date, efforts to discourage the use of cigarettes involving a cigarette dispensing device have not made use of this and other fundamental principles of human psychology. For example, from infancy onward, the rate and direction of a person's psychological and social development largely depend on his increasing capacities to delay impulses, assess the realistic consequences of an act and its alternatives, and defer immediate gratification of an impulse if reason so dictates. As a "stop and think" mode of behavior becomes more firmly established, behavior becomes more adaptive. More mature, albeit delayed, pleasure derives from successful adaptation, mastery over the impulse and, importantly, the approval of others. This delayed form of gratification emerges and reinforces further growth only so long as the frustration of giving up immediate gratification is not intolerable. If the frustration is too great or immediate gratification is too readily available, growth does not occur.

From a psychological standpoint, this is the smoker's dilemma. At the moment he has the pressing urge to satisfy his addictive craving for immediate gratification and reaches for a cigarette or puffs on it, his capacities to delay, exercise mature thought and judgment, and wisely consider the long term consequences of his act are relatively impaired. He literally cannot "stop and think." Immediate gratification from a cigarette is too readily available, and his frustration is too great to be overcome by a relatively weakened capacity to delay and too small an expectation for the more mature form of delayed gratification. Thus, smokers who want to stop give in to their impulses to smoke despite co-existing strong contrary motivations to stop or cut down. They do so impulsively, automatically, or sometimes after a conscious and difficult struggle to resist. Many smokers simultaneously feel a deep-seated inner helplessness, embarrassment and sense of failure at their inability to resist their irrational urges to obtain immediate gratification and achieve mastery over their habit and enjoy delayed gratification.

The present invention is intended to take advantage of the aforementioned psychological principles in providing a device and method which provides various advantages not available in the prior art to discourage smoking and to assist one in reducing, and even eliminating, his dependence upon cigarettes. The present invention operates directly and repeatedly at each moment of decision to smoke a cigarette by forcing the smoker to reconsider his decision following the initial urge to smoke by temporarily delaying access to each cigarette while providing the smoker with up-to-date information regarding past cigarette consumption. In addition, the smoker is encouraged on an individual basis to inhale reduced amounts of smoke once he or she gives in to the urge to smoke and selects a cigarette. The present invention does not compel the smoker to quit altogether, but rather allows him to control the pace of his withdrawal according to individual needs and lessens the possibility of complete discouragement and the giving up of the effort to stop smoking. Access to cigarettes is not completely barred as in other smoking inhibiting devices so as to reduce the incentive of the smoker to circumvent the device by buying more cigarettes and thus giving up on trying to kick the habit. Using a microcomputer, the cigarette dispenser and method of the present invention constantly monitors and analyzes a smoker's changing pattern of cigarette consumption and, on the basis of the information thus gathered and at a pace determined by the smoker's own progress, uses a variety of clinically proven techniques to wean the smoker gradually and systematically from this life-threatening habit. Although capable of performing many complex functions, the programmable cigarette dispenser is as easy to carry as an ordinary pocket cigarette case and provides a private and personalized "anti-smoking clinic in a box" which can be used alone or to supplement conventional smoking cessation programs. Finally, while the present invention is disclosed in terms of its use in a portable cigarette dispenser, it has application in any container which holds a substance for which limited, or reduced, use of or total abstinence is desired.

OBJECTS AND SUMMARY OF THE INVENTION

Accordingly, it is an object of the present invention to assist a smoker in reducing the number of cigarettes consumed and the amount of smoke inhaled from each cigarette.

It is another object of the present invention to provide a cigarette dispenser for limiting smoker access to cigarettes stored therein to predetermined time periods established by the smoker's own rate of smoking.

Yet another object of the present invention is to provide a cigarette dispenser which limits smoker access to cigarettes therein to predetermined time periods and provides an audio and/or visual alarm when the smoker attempts to gain unauthorized access and an audio and/or visual indication of when access is authorized.

Still another object of the present invention is to provide a device for limiting access to cigarettes contained therein to predetemined time periods in which cigarette access may be gained by the smoker only after waiting a designated resettable time interval.

A further object of the present invention is to provide a limited access cigarette dispenser which is easy to use and inexpensive to make.

Another object of the present invention is to discourage cigarette smoking by providing a smoker with access to cigarettes only after the initial urge to smoke has subsided and the smoker has had an opportunity to reconsider.

A still further object of the present invention is to provide a smoker with information regarding his past and present cigarette consumption so as to discourage continued cigarette usage.

Yet another object of the present invention is to provide a microcomputer controlled cigarette dispensing device and method therefor which may be programmed in accordance with the user's individual smoking habits for employing clinically proven techniques to wean the smoker gradually and systematically from the smoking habit.

Still another object of the present invention is to provide an individually programmable cigarette dispensing device which forces the smoker to stop and think before selecting a cigarette and, following the selection of a cigarette, to reconsider the urge to take a puff of the cigarette following the initial occurrence of this urge.

The present invention contemplates a cigarette dispenser including a generally rectangular case having a hinged lid and latch for closing the dispenser. A limit switch which couples the lid to the case actuates a speaker alarm if the lid is opened following a "grace period" while the dispenser is in any mode other than that when cigarette access is authorized. When the user desires authorized access to a cigarette, he engages a manual switch on the outside of the dispenser for initiating countdown of a first timer. The first countdown timer, which is preset and resettable by a user-actuated switch is set automatically as a function of his smoking rate, is coupled to the limit switch for deactivating the limit switch and alarm for predetermined periods following expiration of the countdown interval during which authorized cigarette access may be gained for a short interval.

Following oompletion of the first timer countdown, an audio and/or visual indication is provided that the dispenser is in the authorized access mode, that the alarm circuit is disengaged, and that the dispenser may be opened. If the dispenser is opened in an unauthorized manner without prior running and expiration of the countdown timer and interval following a grace period, an audio alarm timed by a second timer is triggered and emits an embarrassing sound for a predetermined second period of time. The length of the second period is set to cause user embarrassment sufficient to discourage unauthorized lid openings, and the alarm is not user defeatable. By making this audio alarm loud enough to be heard by others who are able to recognize and identify it, social psychological pressure will be brought to bear upon the user to discourage him from making unauthorized use of the cigarette dispenser. Event counters for counting authorized and unauthorized lid openings as well as the number of times the lid was not opened, i.e., a cigarette was skipped, following expiration of the first countdown is provided. The current smoking rate is updated. Successful use results in incrementing the delay for the next cigarette. Unauthorized use results in decrementing the delay for the next cigarette.

When the dispenser is opened following the countdown interval, a third timer is triggered for counting a third period. If the dispenser is not closed by the end of this third period, an audio alarm is triggered to encourage the user to close the dispenser. The length of the third period is set to permit the removal of, for example, one cigarette from the dispenser. A manual mode of the dispenser permits the user to preset and reset the first countdown period for awaiting authorized access to a cigarette. Thus, the user may give himself more or less time to wait and reconsider his initial decision to smoke a cigarette ahead of time but cannot reset this time at the moment he wants a cigarette. The first timer resets itself automatically to an interval determined by the current smoking rate and according to whether a cigarette was authorized, skipped or unauthorized unless the user resets it.

During the first countdown period various audio and/or visual messages are provided to the user. These messages are intended to discourage the smoking of the next cigarette and include such information as the total number of times the dispenser has been opened to remove a cigarette, the number of times the timer has counted down and the dispenser has not been opened and the number of times the dispenser has been opened while in authorized and unauthorized access modes. Logic circuitry is provided for determining the optimal countdown period for user rejection of the next cigarette for an individual user based upon past usage. In addition, various audio warnings, including synthesized voice messages and musical tones, may be provided during this timer countdown interval to further discourage the removal of a cigarette from the dispenser.

The present invention thus operates upon the principle that a smoker who is about to reach for a cigarette would be more likely to delay lighting up or skipping the cigarette altogether, thus reducing his cigarette consumption, if he is simultaneously:

a. Alerted to the fact that he is now making a crucial decision regarding his well-being and is thus prevented from thoughtlessly giving in to his urge;

b. Given credible information about his smoking pattern on which he may base a rational decision;

c. Given sufficient time and several opportunities to reconsider his decision and resist his urge; and d. Given positive reinforcement for resisting his urge; or e. Given negative reinforcement for giving in to his urge.

Another feature of the present invention includes an automatic, programmable mode wherein operation of the cigarette dispenser is under the control of a microcomputer. In this mode, the topography of a smoker's habit is compared on a real time basis to a baseline characteristic stored in memory. This baseline characteristic may be derived from the smoking pattern of the user over an initial baseline period or may be pre-programmed into the cigarette dispenser. Subsequent use of the cigarette dispenser is then compared with this baseline characteristic and positive reinforcement is automatically provided for resisting not only the urge to smoke, but also to decrease the number and length of puffs taken per cigarette, while negative reinforcement is provided for giving into these urges. This reinforcement is in the form of audio and/or visual indications generated in response to the user's smoking behavior.

If, when a smoker succeeds in waiting out his urge or in skipping a cigarette, his wait is slightly prolonged for the next cigarette, e.g., the waiting period is increased by one minute, to permit the smoker to gradually gain mastery over his urge and confidence in his ability to overcome this urge. Eventually the user's cigarette consumption will dramatically decline or even cease. Similarly, when the smoker cannot resist his urge to light up a cigarette, his wait for the next cigarette is slightly decreased, with the waiting period eventually becoming short enough for the smoker to succeed in abstaining from a cigarette for the entire waiting period. The user then proceeds from that point and, after experiencing successful use of the cigarette dispenser and being able to abstain for the entire waiting period, becomes less likely to give up his effort in frustration.

In addition, after the smoker lights up a cigarette, the cigarette dispenser provides a reminder to put out the cigarette sooner than the smoker might otherwise have disposed of the cigarette based upon the user's smoking characteristics. This same principle is used in the present invention in providing an audio/visual signal to the user each time he has an urge to puff a lit cigarette in order to make the user aware that he is at a decision point and to assist him in waiting out this urge for progressively longer intervals resulting in reduced numbers of puffs being taken and less smoke inhaled. When the smoker exceeds his usual rate of smoking he is alerted to slow down and will be less likely to chain smoke. The cigarette dispenser of the present invention affords the smoker with a portable, programmable appliance which he can use voluntarily and conveniently and which is programmed by his own smoking characteristics. These features of the cigarette dispenser increase the likelihood that the user will make a serious attempt to stop, or at least reduce, smoking even though previous attempts using other approaches have failed.

The programmable cigarette dispenser of the present invention gathers credible information about the smoker's baseline and current smoking behavior; analyzes this information and provides it to the smoker at key moments in his decision making process; couples this credible feedback with personalized anti-smoking messages and health warnings; gives the smoker several chances to reconsider his decision until the very last moment of taking out a cigarette and encourages the smoker to put out a cigarette soon after it is lighted; encourages the smoker to adhere to his own self-prescribed program to cut down or quit smoking; gently but firmly embarrasses the smoker for not adhering to a self-prescribed program to cut down/quit smoking with a distinctive alarm; and gradually weans him off cigarettes as it adjusts the waiting period for a cigarette to the rate of progress the smoker himself is making. The programmable cigarette dispenser gradually automatically shortens the wait for a cigarette each time the user cheats or lengthens it each time the cigarette dispenser is used successfully. The programmable cigarette dispenser detects excessive rates of use, alerts the smoker to slow down and provides the user with a final request to skip the cigarette by means of a synthesized voice just prior to withdrawal of a cigarette as well as a "grace period" during which the user may decide against withdrawing a cigarette from the dispenser and merely close the dispenser's lid.

Following withdrawal of a cigarette, the programmable cigarette dispenser alerts the smoker to put out the cigarette early and gives him a chance to wait out his urge to puff or to skip each puff altogether. The programmable cigarette dispenser is adapted to interface with a personal computer in the smoker's home, a smoking cessation clinic, or a doctor's office in order to provide data to a master computer for analyzing and documenting the progress of the smoker or a group of smokers. This information may be used to promote smoking cessation, enhance group treatment effectiveness, and study patterns of use of the programmable cigarette dispenser and smoking cessation behavior. The programmable cigarette dispenser is powered by rechargeable batteries to permit continuous operation and prevent loss of data stored in its memory.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

Figure 1:
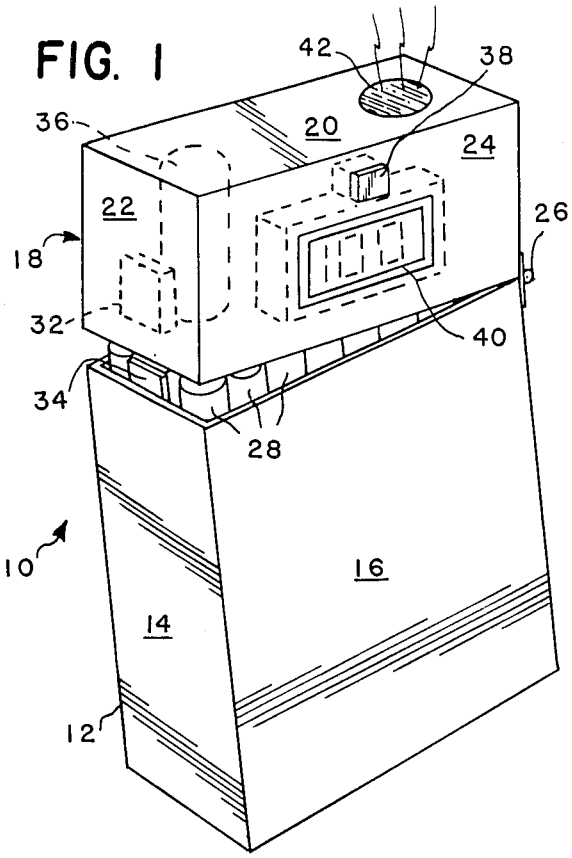
FIG. 1 is a perspective view of a cigarette dispenser in accordance with the present invention.
Figure 2:
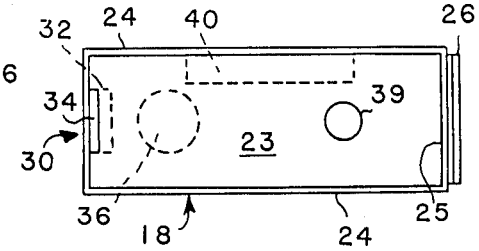
FIG. 2 is a view of a lower portion of the lid of the cigarette dispenser shown in FIG. 1.
Figure 3:
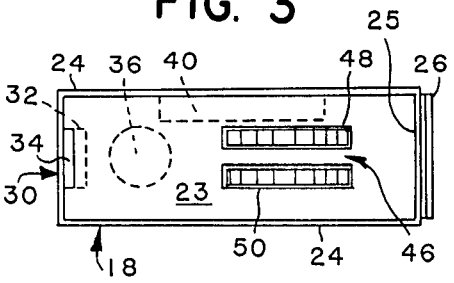
FIG. 3 shows another embodiment of the lower portion of the lid of the cigarette dispenser shown in FIG. 1.

Referring to FIGS. 1, 2 and 3, there are shown various views of a cigarette dispenser 10 in accordance with the present invention.

The cigarette dispenser 10 includes a generally rectangular, elongated case 12 made preferably of a molded hard plastic, which includes a front wall 14, a rear wall (not shown), side walls 16, and a lower wall (not shown). The various walls forming case 12 are coupled so as to form an enclosure into which a conventional pack of cigarettes 28 may be placed. The upper end portion of the case 12 thus formed by the various aforementioned walls is open and mounted thereto by means of a hinge 26 is a lid 18. Lid 18 similarly is comprised of a front wall 22, a lower wall 23, side walls 24, and a rear wall 25. The lower wall 23 of lid 18 is recessed from the lower edge of the lateral walls of the lid so as to provide clearance for the upper end portions of cigarettes 28 positioned within case 12 when the lid is in a closed position.

Positioned on a front portion of the cigarette dispenser 10 is a limit switch 30 which includes a latch mechanism 32 coupled to the inner portion of the lid's front wall 22 and a clasp 34 mounted to the inner surface of the front wall 14 of case 16. Latch mechanism 32 engages clasp 34 when the lid 18 is in the closed position. It is contemplated that the combination of latch mechanism 32 and clasp 34 may make use of conventional components and be of conventional design. For example, the engagement of the latch mechanism 32 with the clasp 34 may be purely mechanical in nature or may be in the nature of an electromechanical engaging force. Whatever the mechanical design of the combination of latch mechanism 32 and clasp 34, the limit switch 30 which they comprise is electrically actuated as explained below.

Also located within lid 18 in the upper wall 20 thereof is a speaker 42. Opening of the cigarette dispenser 10 causes the limit switch 30 to close thus activating speaker 42 which emits an audio alarm in order to discourage the user from opening the cigarette dispenser during unauthorized periods. The emission of an embarrassing sound from speaker 42 is intended to further discourage the user from opening the cigarette dispenser at unauthorized times. The duration of the alarm sound is determined by a timer circuit and is not user defeatable. A display, such as a light emitting diode (LED) or liquid crystal diode (LCD) display, 40 positioned on an outer surface of the cigarette dispenser 10 provides a visual indication of when the cigarette dispenser 10 may be opened in an authorized manner in accordance with timing information it is programmed with. Opening of the cigarette dispenser 10 when the display 40 is not illuminated will similarly result in an audio alarm being emitted from speaker 42.

Also located on lid 18 is a pushbutton switch 38 which permits the cigarette dispenser 10 to be opened without sounding the aforementioned audio alarm. When the pushbutton switch 38 is engaged, a delay timer (described below) is actuated for counting down a predetermined time period. Upon expiration of this timer countdown delay, the display 40 is illuminated signalling to the user that the cigarette dispenser 10 may be opened without sounding the audio alarm. The same timer circuit will trigger the audio alarm from speaker 42 if the limit switch 30 is not engaged within a predetermined time period following the opening of lid 18. This permits the user to open the cigarette dispenser only for a short period, e.g., long enough to permit the removal of a single cigarette, before the audio alarm is automatically triggered. Once speaker 42 is thus actuated, it cannot be defeated and the audio alarm will sound for a predetermined time period.

Also positioned within the lid 18 is a conventional dry cell storage battery 36 for energizing the various circuitry, alarms and displays of the present invention. Battery 36 provides a DC voltage source for energizing the electrical circuitry of the cigarette dispenser 10 which is described below.

Figure 4:
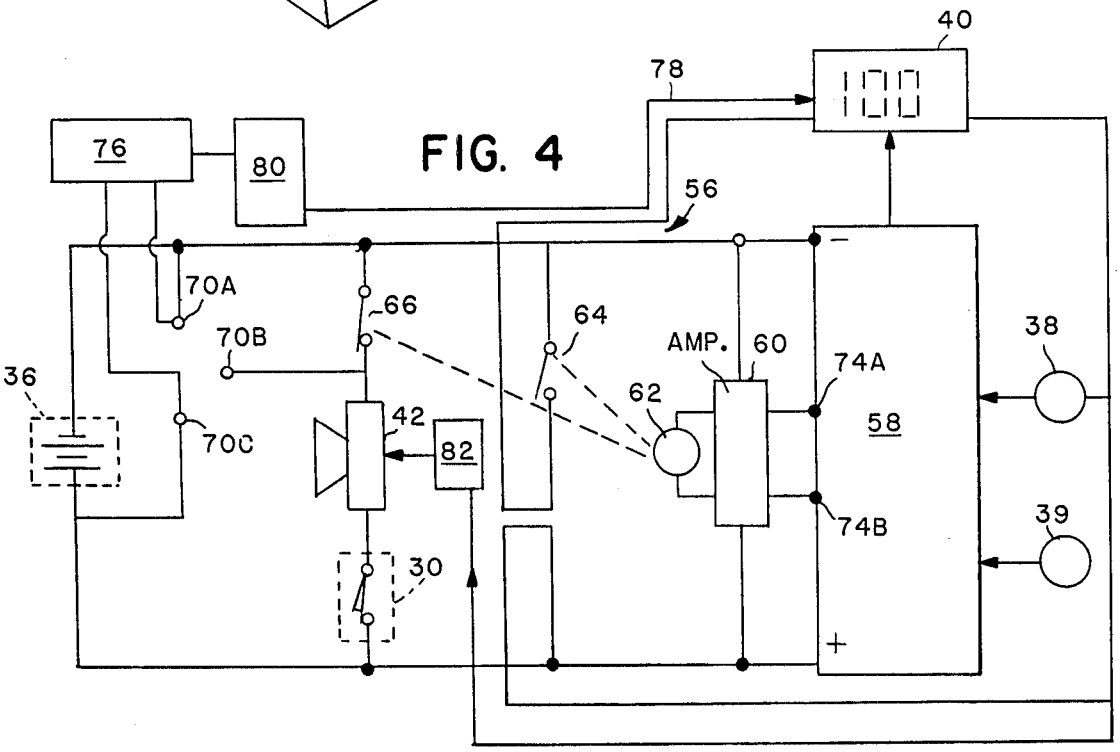
FIG. 4 shows partially in block diagram form and partially in schematic diagram form an electrical circuit for use in the cigarette dispenser of the present invention.

In addition to providing a visual indication of when the cigarette dispenser 10 may be opened without actuating speaker 42, the display 40 is coupled to an event counter 76 shown in FIG. 4 for displaying such information as the number of times the cigarette dispenser has been opened to remove a cigarette, the number of times the delay timer counted down to zero and the dispenser was not opened, the number of times the dispenser 10 has been opened without setting of and/or prior to expiration of the timer countdown and the time remaining in the timer countdown period. Details regarding how these various numbers are generated and displayed are provided in the following paragraphs.

Referring to FIG. 2, there is shown the lower wall 23 of lid 18. Positioned in the lower wall 23 is a pushbutton switch 39 by means of which the user may set the predetermined first countdown time interval between selection of switch 38 following the initial decision to smoke a cigarette and when the cigarette dispenser 10 may be opened in an authorized manner without actuating speaker 42 and triggering the audio alarm. For example, each engagement of pushbutton switch 39 may increase the first countdown period by a predetermined time increment. Continued actuation of pushbutton switch 39 would cause a predetermined maximum time to be exceeded whereupon the timer would roll-over to a predetermined minimum time whereupon the selected time interval would again increase with continued engagement of switch 39. Such arrangements are well known to those skilled in the art.

Referring to FIG. 3, there is shown another arrangement for presetting the desired time interval between the selection of switch 38 and when the cigarette dispenser 10 may be opened without actuating speaker 42 and triggering the audio alarm. This arrangement of the present invention includes a timer control 46 comprised of two rotary dials 48, 50, each of which is in the form of a thumbwheel. In a preferred embodiment, rotary dial 48 is calibrated in one minute increments, up to ten minutes, while rotary dial 50 is calibrated in ten minute increments up to fifty minutes. Thus, by manually setting in a selected time period on timer control 46, the user may fix the length of time between the selection of switch 38 and when the display 40 is illuminated indicating that the cigarette dispenser 10 may be opened without actuating speaker 42. It is to be noted that in the embodiment shown in FIG. 2 as well as that shown in FIG. 3, the time between the decision to smoke a cigarette and when authorized access to a cigarette is provided without triggering an audio alarm may be set, or changed, by the user only if lid 18 is in an open position. This insures that the user may not circumvent the timing sequence of the cigarette dispenser 10 in order to gain unauthorized access to the cigarettes therein.

Referring to FIG. 4, there is shown in simplified schematic and block diagram form a control circuit 56 for use in the cigarette dispenser 10 of the present invention. The operation and configuration of the control circuit 56 shown in FIG. 4 will now be explained with respect to the various components of the cigarette dispenser 10 shown in FIGS. 1, 2 and 3.

The control circuit 56 is energized by a DC voltage source in the form of a dry cell battery 36. Battery 36 is coupled across the positive and negative terminals of a timer circuit 58. Timer circuit 58 is a conventional countdown timer, the timing period of which may be established by means of a pushbutton switch 39, or in an alternate embodiment in the form of timer control 46, as previously described. Once timer circuit 58 is thus programmed, its contents are then provided to the digital display 40 for displaying this information thereon. The MM5865 Universal Timer available from National Semiconductor Corporation of Santa Clara, Calif. may be used in the present invention for timer circuit 58.

While the invention is in the default or unauthorized access mode, the cigarette dispenser 10 is closed, second switch 66 is closed, and limit switch 30 which is in series with speaker 42 and second switch 66 is open. When the cigarette dispenser 10 is opened in an unauthorized manner, switch 30 will be closed resulting in the actuation of speaker 42.

Authorized access is gained in the following manner: If the second switch 66 is open speaker 42 will not be actuated whether switch 30 is in the open or closed position. Following the initiation by the selection of pushbutton switch 39 of the countdown of the pre-set time interval by timer circuit 58 and completion of the countdown interval, a signal appears across its output terminals 74A, 74B and is provided to amplifier 60. Amplifier 60, in turn, amplifies the timed output from timer circuit 58 and provides the thus amplified signal across relay coil 62 which is inductively coupled to a first switch 64 and a second switch 66. The first switch 64, which is normally open, is closed upon receipt of the output from relay coil 62 for turning on display 40 in providing a visual indication that the cigarette dispenser 10 may be opened in an authorized manner in accordance with the programmed timing information in timer circuit 58. The second switch 66, which is normally closed, opens in response to an output from relay coil 62 at the same time that the first switch 64 is closed. The opening of the second switch 66 results in the deenergization of speaker 42 so as to preclude the emission of an audio alarm therefrom upon opening of the cigarette dispenser 10. Following the countdown of timer circuit 58, expiration of the predetermined time interval determined by a preset value in timer circuit 58, timer 58 is automatically reset to its preset time and the voltage applied across output terminals 74A and 74B is removed. This results in the deactivation, or disengagement, of switch 64 and the turning off of display 40. In addition, switch 66 is again placed in the closed position so as to energize speaker 42 and activate limit switch 30. This arrangement reestablishes the limited access default mode of operation of the cigarette dispenser 10.

Also provided for in control circuit 56 are various terminals 70A, 70B and 70C. Various additional conventional components may be easily incorporated in the control circuit 56 so as to provide additional features in the cigarette dispenser 10 of the present invention. For example, an event counter 76 may be coupled across terminals 70A and 70C for counting such occurrences as the number of times that limit switch 30 is opened for withdrawal of a cigarette from the cigarette dispenser 10, the number of times timer circuit 58 counts down to zero and the cigarette dispenser 10 is not opened, the number of times timer circuit 58 counts down to zero and the cigarette dispenser 10 is opened, and the number of times the cigarette dispenser 10 is opened without actuation of timer circuit 58 and/or prior to expiration of timer circuit 58 countdown. The display of the various aforementioned user smoking characteristics is accomplished by means of a logic and display driver circuit 80 coupling the event counter 76 to display 40. These values could also be provided on display 40 by coupling the counter 76 to the digital display 40 via line 78. Such logic and display driver circuits are well known to those skilled in the art, although a preferred embodiment of such circuitry is described in detail below.

The present invention also contemplates the use of an audio device 82 such as a voice synthesizer or recorder coupled to speaker 42 for driving speaker 42 during the time period between the selection of pushbutton switch 38 following the decision to smoke and when the cigarette dispenser 10 may be opened without sounding the audio alarm. Audio device 82 may be programmed with various warnings regarding the dangers of smoking which are provided to speaker 42 to further discourage the user from smoking a cigarette after the initial urge to smoke occurs and he has initiated the process to gain authorized access to cigarettes within dispenser 10. The present invention is not limited to the counting and display of the aforementioned numbers, but is capable of measuring and displaying other parameters relating to the smoking habits of a user of the cigarette dispenser 10.

Figure 5:
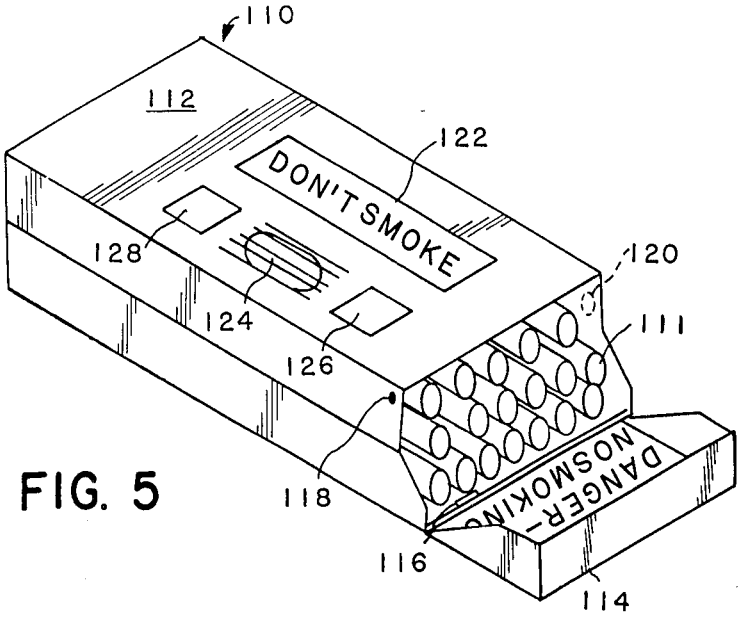
FIG. 5 is a perspective view of another embodiment of a cigarette dispenser in accordance with the principles of the present invention.

Referring to FIG. 5, there is shown another embodiment of the present invention in the form of a programmable cigarette dispenser 110 which is user programmable and particularly adapted to take into account the smoking behavior characteristics of the user for weaning the smoker away from cigarette use. FIG. 5 is a perspective view of the case 112 of the programmable cigarette dispenser 110, while FIG. 6 is a simplified combined block and schematic diagram of a logic and display drive system 130 for use in the programmable cigarette dispenser 110.

As in the first embodiment of the cigarette dispenser of the present invention described above, the programmable cigarette dispenser 110 includes a case 112 which is open at one end thereof. Pivotally coupled to the case 112 at the open end thereof by means of a hinge 116 is a lid 114. The case 112 is adapted to receive and store a plurality of cigarettes 111 therein. First and second contact switches 118, 120 are positioned on respective lateral surfaces of the case 112 adjacent to the open end thereof. The first and second contact switches 118, 120 detect the closure and opening of the lid 114 and provide signals in response to such movement of the lid to a central processing unit (CPU) and input/output (I/O) interface 132 circuit of the logic and display drive system 130 as shown in FIG. 6. With the first and second oontact switches 118, 120 coupled in parallel to the CPU 132 and positioned on respective lateral portions of the cigarette dispenser's case 112, the CPU 132 is provided with a reliable indication of the position of the lid 114. Also positioned on an outer, lateral surface of the cigarette dispenser's case 112 is a liquid crystal diode (LCD) display 122 upon which are presented various alphanumeric messages for the cigarette dispenser's user relating to his up-to-the-minute usage of the cigarette dispenser as well as various messages encouraging the user to reduce/stop smoking as described below. Also positioned upon a lateral surface of the cigarette disenser's case 112 is an audio speaker 124 for providing aural messages to the user regarding his smoking habits and encouraging the user to reduce/terminate his smoking habit.

Positioned upon a lateral, outer surface of the cigarette dispenser's case 112 is an URGE selector, or switch, 126 and a MODE selector, or switch, 128. The user selectable URGE and MODE switches 126, 128 are respectively engaged when the user desires to remove a cigarette from the case 112 or to puff on a cigarette which has already been removed from the case and to change the operating mode of the programmable cigarette dispenser 110. The various operations carried out by the programmable cigarette dispenser 110 upon selection of either the URGE selector 126 or the MODE selector 128 are described in detail in the following paragraphs.

Figure 6:
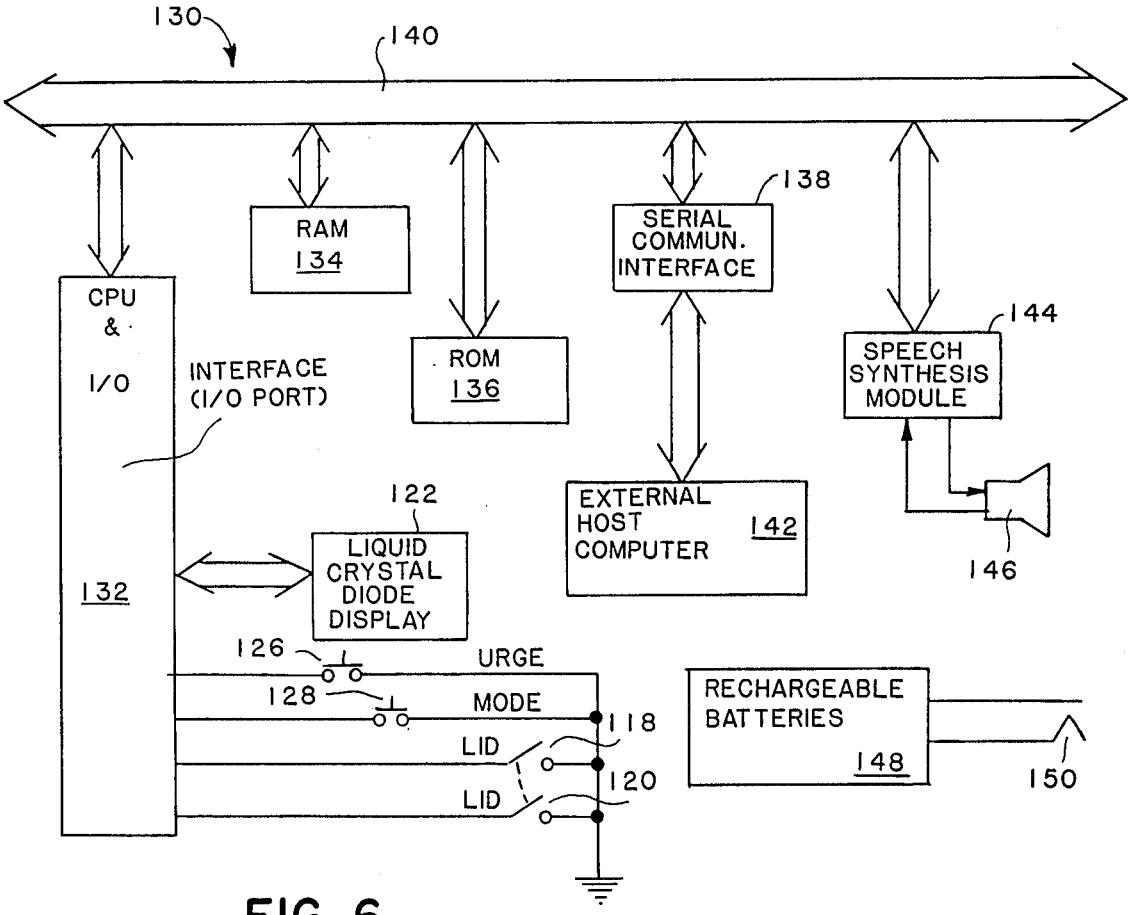
FIG. 6 is a simplified schematic and block diagram of the logic, display drive, interface, and speech synthesis circuitry used in a preferred embodiment of the present invention.

Referring specifically to FIG. 6, the logic and display drive system 130 shown therein includes the central processing unit (CPU) and input/output (I/O) interface circuit 132 to which various user initiated inputs are provided by means of the URGE and MODE selectors 126, 128. In addition, information regarding smoker use of the programmable cigarette dispenser 110 is provided via the first and second contact switches 118, 120 to the CPU 132. The CPU 132 utilized in a preferred embodiment of the present invention is the 8-bit CMOS, single chip 146805 E2 microcomputer available from a number of integrated circuit manufacturers. However, the present invention is not limited in its application to the use of this particular microcomputer, but will operate equally well with any conventional microcomputer.

The CPU 132 is coupled by means of a data/address bus 140 to a random access memory (RAM) 134, a read only memory (ROM) 136, a serial communications interface unit 138, and a speech synthesis module 144. The data/address bus 140 is bi-directional and permits the CPU 132 to either write data into or read data from the RAM 134 as well as to read from the ROM 136 program instructions which control the operation of the CPU. User inputs and operating parameters are provided from the URGE and MODE switches 126, 128 as well as from the first and second contact switches 118, 120 via the CPU 132 to the RAM 134 for storage therein. The RAM 134 serves as a scratchpad register for the temporary storage of various operating parameters which are either entered by the user or represent the smoking behavior characteristics of the user as described below. The ROM 136 is comprised of a nonvolatile memory matrix having a plurality of memory locations or "bytes" of 8 bits each in the preferred embodiment. Program instructions and data are stored within the ROM 136 from which these instructions and data are sequentially removed under the control of the CPU 132 in reading out each instruction to be executed by the CPU for carrying out various program functions. A 2764 read only memory integrated circuit is used for the ROM 136 in a preferred embodiment. Referring to Table I, there is shown in BASIC language a computer program in conceptual form for controlling the operation of the CPU 132 in accordance with the principles of the present invention. Actual programming of the CPU 132 would, of course, require that the BASIC program set forth in Table I be converted to assembly language in the form of a computer listing using conventional techniques well known to those skilled in the art.

The RAM 134 used in a preferred embodiment is the 6264 random access memory available from a number of integrated circuit sources. The RAM 134 has a memory matrix organization for the temporary memory storage of a large number of words, with each word represented by a plurality of individual bits. Each bit may be used as a flag to indicate whether a particular event has occurred or the individual flags can be used in combination in the form of a counter for timing various events.

TABLE I

```
10 I$="HABITBREAKER. AN ANTISMOKING/ANTIHABIT PROGRAM 12/8/84 E D SCHWARZ MD. CO
PYRIGHT1984 E.D.SCHWARZ":CLS:PRINT I$:GOSUB 810:GOSUB 810
20 '
30 'A PROGRAM FOR THE COMPUTER OR PORTABLE DEVICE TO AID HABITUATED INDIVIDUALS
 TAPER THEIR NEED FOR THE ADDICTING SUBSTANCE: TOBACCO, FOOD, OR ANY OTHER. IN T
HIS PROGRAM CIGARETTES ARE THE SUBSTANCE OF CONCERN, BUT PROGRAM IS NOT LIMITED
TO CIGARETTES.
40 'THE HABITUATED PERSON IS AIDED TO RESIST THE URGE TO USE THE ADDICTING SUBST
ANCE FOR LONGER AND LONGER DELAYS SET AUTOMATICALLY BY THE PROGRAM OR MANUALLY B
Y USERS.THE USER GETS POSITIVE AND NEGATIVE FEEDBACK OF HIS PROGRESS TO ENCOURAG
E ABSTINENCE.
50 'THE PROGRAM KEEPS TRACK OF HOW THE USER PROGRESSES AND ADJUSTS TIME INTERVAL
```

TABLE I (CONT'D)

```
S AND INFORMS THE USER BY VIDEO,LCD OR SYNTHESIZED VOICE ACCORDINGLY.THE CONSEQU
ENCE OF CHEATING THE PROGRAM IS A DISTINCTIVE EMBARASSING ALARM.INTERVALS MAY VA
RY FROM BELOW.
60 '
70 '
80 '*SET TIME INTERVALS
90 TIME$="0:":LIDOP=5:DELINC1=2:DELINC2=1:AUTHAC=20:ALA=30:'*SET TIME=0,LID OPEN
 BEFORE ALARM IN SECS,INCREASE IN DELAY WITH EACH SKIP,INCREASE WITH EACH SUCCES
SFUL USE,DURATION OF AUTHORIZED ACCESS AFTER DELAY EXPIRATION,ALARM DURATION
100 DISPL=30:LIDOPAL=5:DELDEC=1:MINDEL=20:MAXDEL=58:'*SET TIME FOR DISPLAY TO FL
ASH.FOR OPEN LID TO PROMPT CLOSING.DELAY DECREASE FOR CHEATING.MIN DELAY.MAX DEL
AY
110 GOTO 210
120 '
130 CLS:CIG=20:LOCATE 1,1:GOSUB 790:GOSUB 800:PRINT"YOU ARE OUT OF CIGARETTES."
:LOCATE 16,1:INPUT"TO LOAD PACK PRESS ENTER ",I$:OPN=1:IF I$<>""THEN 130 :'*LOAD
 PACK.SET NUMBER OF CIGS TO 20
140 '
150 '
160 CLS:IF DEL=0 THEN 170 ELSE GOSUB 720:GOSUB 760:GOSUB 800:INPUT"SET DELAY? ",
I$:IF I$="N" AND DEL THEN 220 ELSE IF I$<>"Y" THEN 160
170 CLS:GOSUB 790:GOSUB 800:INPUT "NEW DELAY=",DEL:IF DEL<MINDEL OR DEL >MAXDEL
THEN 170:'*SET DELAY IN SECS
180 '
190 '
200 '
210 '*DEFAULT AND SELECT MODES
220 IF OPN THEN GOSUB 580:'*MAKE SURE LID IS CLOSED
230 GOSUB 800:CLS:LOCATE 19,1:INPUT"DEFAULT MODE: BOX CLOSED. DISPLAY BLANK. PUS
H BUTTON (ENTER KEY) WHEN YOU WANT  TO SMOKE",I$:'*DEFAULT MODE
240 GOSUB 790:GOSUB 510:CLS:LOCATE 19,1:PRINT"SELECT MODE":FOR X=1 TO 300:LOCATE
 20,1:PRINT"PRESS:     1 TO PUSH BUTTON TO START COUNTDOWN        2 TO OPEN LID":I
$=INKEY$ :'*SELECT MODE
250 IF I$="" THEN 280
260 IF CIG=0 THEN 130:'*GO TO REFILL PACK IF CIG=0
270 CLS:ACTION=VAL(I$):IF ACTION<1 OR ACTION>2 THEN 230 ELSE ON ACTION GOTO 360,
310
280 NEXT X:GOTO 230
290 '
300 '*CHEATING MODE
310 IF CIG=0 THEN 130 ELSE CLS:GOSUB 800:GOSUB 790:PRINT"SMOKING IS DANGEROUS TO
 YOU AND YOUR LOVED ONES. BY CHEATING ME YOU ARE CHEATINGYOURSELF!":LOCATE 16,1
320 PRINT"CHEATING MODE:UNDEFEATABLE UNPLEASANT ALARM. DELAY SHORTENED.":GOSUB 7
60:GOSUB 640:CHEAT=CHEAT+1:TOTAL=TOTAL+1:CIG=CIG-1:IF DEL=MINDEL THEN 330 ELSE L
ET DEL=DEL-DELDEC
330 GOTO 220
340 '
350 '*COUNTDOWN MODE
360 CLS:TIME=DEL:GOSUB 780:GOSUB 790:PRINT"PLEASE DON'T LET YOUR LIFE GO UP IN S
MOKE!    WAIT OUT YOUR URGE.":GOSUB 680:IF EP=1 THEN 310:'DELAY COUNTDOWN. IF LI
D OPEN BEFORE EXPIRATION THEN = CHEAT
370 '
380 '*AUTHORIZED ACCESS MODE
390 TIME=AUTHAC:GOSUB 780:GOSUB 790:PRINT"YOU CAN GET A CIGARETTE. BUT TRY TO SK
IP IT.":GOSUB 680:IF EP=1 THEN 450:'AUTHORIZED ACCESS COUNTDOWN. IF BOX  OPENED
GOTO SUCCESSFUL USE
400 '
410 '*SKIPPING MODE
420 SKIP=SKIP+1:DEL=DEL+DELINC1:CLS:GOSUB 790:PRINT"CONGRATULATIONS ON SKIPPING
THIS CIGARETTE. YOU ARE PROLONGING YOUR LIFE!":SOUND 783.99,27.3:SOUND 783.99,27
.3:SOUND 1046.5,13.6:GOSUB 810:GOSUB 810:GOTO 220:'SKIPPING  REGISTERED AND DELA
Y INC
430 '
440 '*SUCCESSFUL USE MODE
450 GOSUB 580:SUCCESS=SUCCESS+1:DEL=DEL+DELINC2:CIG= CIG-1:TOTAL=TOTAL+1:IF CIG=
0 THEN 130 ELSE 220:'SUCCESSFUL USE.INCREASE DELAY. IF OUT OF CIGARETTES GOTO RE
LOAD OTHERWISE DEFAULT
460 '
470 '
480 T=VAL(MID$(TIME$,7)):RETURN:'*CONVERT TO TIME IN SECONDS
```

TABLE I (CONT'D)

```
490 '
500 '*DISPLAY
510 CLS:GOSUB 790:GOSUB 790:PRINT:PRINT:PRINT
520 IF TOTAL=0 THEN 530 ELSE PRINT"YOU HAVE SMOKED A TOTAL OF";TOTAL:GOSUB 810
530 IF SKIP=0 THEN 540 ELSE PRINT"CONGRATULATIONS! YOU HAVE SKIPPED";SKIP:GOSUB
810
540 IF CHEAT=0 THEN 550 ELSE PRINT"BUT YOU CHEATED WITH";CHEAT:GOSUB 810
550 IF SUCCESS+SKIP=0 THEN 560 ELSE PRINT"YOU HAVE USED ME WELL WITH";SUCCESS+SK
IP:GOSUB 810
560 PRINT:PRINT"YOU HAVE";CIG;"CIGARETTES LEFT AND A DELAY OF";DEL;"SECONDS":PRI
NT:PRINT"PLEASE DON'T SMOKE!!!":GOSUB 810:GOTO 810
570 '
580 GOSUB 800:I$="":CLS:TIME$="0:":FOR X=1 TO 300:'*ROUTINE TO CLOSE OPEN BOX
590 LOCATE 20,1:GOSUB 790:PRINT"BOX IS OPEN.":LOCATE 16,1:PRINT"PRESS C TO CLOSE
 BOX":I$=INKEY$:IF I$="C" THEN 620
600 GOSUB 480:IF T<=LIDOP THEN 610 ELSE GOSUB 800
610 NEXT X
620 OPN=0:RETURN
630 '
640 TIME=ALA:'*ALARM ROUTINE
650 ALARM=1:'ALARM OF DURATION ALA
660 '
670 '*TIMER ROUTINE
680 NUM1=0:I$="":TIME$="0:":RESTORE 820:FOR X=1 TO 100^6:GOSUB 480:IF T>TIME THE
N 750 ELSE IF DISPLAY THEN 690 ELSE LOCATE 3,75:PRINT TIME-T;:IF ALARM THEN 690
ELSE LOCATE 16,1:PRINT"PRESS O TO OPEN BOX  ";:I$=INKEY$:IF I$="O"THEN 760 :'TIM
ER S
690 IF ALARM THEN SOUND 37,2:'*ALARM SOUND
700 '
710 NUM=INT((TIME-T)/2):IF (TIME-T)/2<>NUM OR NUM=NUM1 THEN 720 ELSE READ ILL$:G
OSUB 790:LOCATE 7,1:PRINT SPACE$(79):LOCATE 7,30:PRINT ILL$:NUM1=NUM:'*DISPLAY I
LLNESSES
720 IF NUM/25=INT(NUM/25) THEN RESTORE 820
730 '
740 NEXT X
750 EP=2:GOTO 770
760 OPN=1:EP=1:GOTO 770
770 GOSUB 800:ALARM=0:DISPLAY=0
780 LOCATE 15,1:PRINT SPACE$(79);:RETURN
790 COLOR 0,7:LOCATE 1,1:PRINT STRING$(79,"_"):LOCATE 14,1:PRINT STRING$(79,"_")
:LOCATE 1,23:PRINT"(LCD DISPLAY AND/OR VOICE SYNTHESIZER:)":COLOR 7,0:RETURN:'*S
ET UP SCREEN DISPLAY
800 SOUND 2000,.3:RETURN:'*PROMPT BEEP
810 FOR X=1 TO 3000:NEXT X:RETURN:'*DELAY
820 DATA LUNG CANCER,MOUTH CANCER, BLADDER CANCER, HEART DISEASE, HEART ATTACKS,
 FIRES, EMPHYSEMA, BRONCHITIS, BAD BREATH, DIRTY TEETH, STINK, EXPENSIVE, CHEST
PAIN, LEG CRAMPS, BLINDNESS, EARLY DEATH, SMELLY HANDS, STAINED FINGERS
830 DATA TWITCHES, POOR TASTE, SHORT WIND, DEFORMED BABY, BURNS, HOLES IN CLOTHE
S,SMELLY CLOTHES
```

when instructed by the CPU 132, the contents of a directly addressed location within the RAM 134 are transferred to the CPU 132 and the reverse process may also be accomplished by means of the proper instruction from the ROM 136. Information stored in the RAM 134, which is a volatile memory, is lost when power is removed from the programmable cigarette dispenser 110. The programmable cigarette dispenser 110 includes and is energized by rechargeable batteries 148 which, in turn, are coupled to a charging jack 150 to permit the recharging of the batteries when necessary. When power is applied to the logic and display drive system 130, the program stored within the CPU 132 initializes RAM data from the ROM 136 which causes the binary signals representing the first instructions stored in the ROM to be provided to the CPU 132 and causes various other portions of the CPU 132 to be initialized for proper future operation.

The serial communications interface unit 138 couples the CPU 132 to an external host computer 142 via the data/address bus 140. The 6850 serial communications interface unit is used in a preferred embodiment of the present invention and serves to convert the parallel 8-bit data on the data/address bus 140 to a serial data stream for proper interfacing with the external host computer 142 which may be conventional in nature. In addition, the CPU 132 is coupled via the data/address bus 140 and a speech synthesis module 144 to a speaker 146. The speech synthesis module 144 may be conventional in design and operation and serves to convert the digital signals generated by the CPU 132 in response to instructions stored within the ROM 136 to analog form for driving the speaker 146. The CPU 132 is further coupled to a liquid crystal diode (LCD) display 122 for providing alphanumeric character information thereto for displaying various smoking oriented messages for the user of the programmable cigarette dispenser as described below. Finally, while not shown in FIG. 6, an address decoder would be included in the logic and display drive system 130 of FIG. 6. Such an address decoder could be conventional in design and operation and is not shown in FIG. 6 for the sake of simplicity.

Figure 7A:
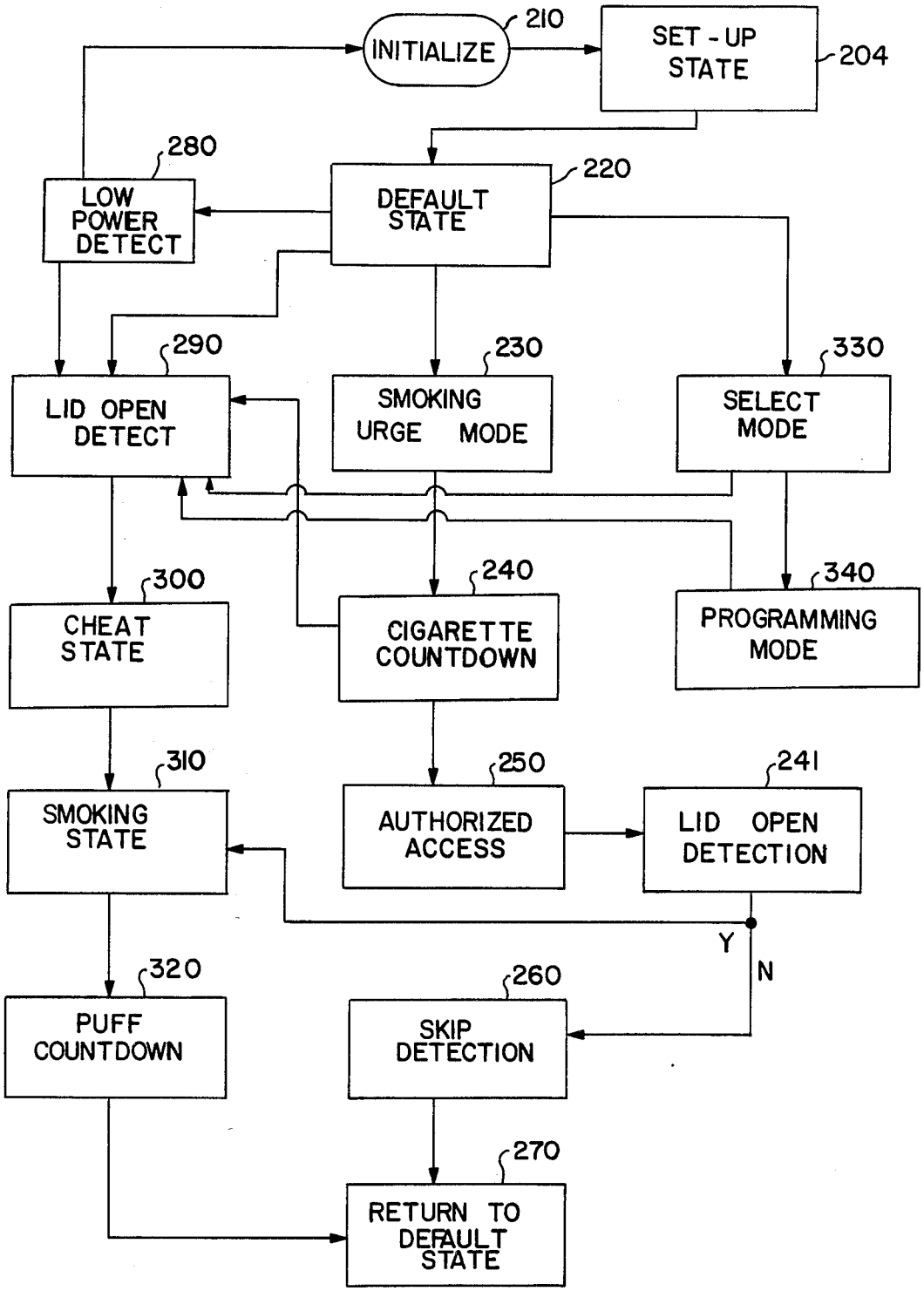
FIGS. 7A–7F illustrate various flow diagrams representing the set of instructions stored in and operations carried out by a microcomputer in controlling the operation of the cigarette dispenser of the present invention.

Referring to FIG. 7A, there is shown in generalized form a flow chart representing the sequence of operations carried out by the CPU 132 in the logic and display drive system 130 for operating the programmable cigarette dispenser in accordance with the principles of the present invention. The CPU 132 would perform the various functions shown in FIG. 7A in response to an operating program shown, for example, in BASIC form in Table I, although this conceptual program would have to be put in assembly language form for proper interfacing with the CPU 132. In referring to the flow charts of FIGS. 7A–7F, an oval symbol indicates the start of an operational sequence, a diamond symbol indicates a decision point based upon the comparison of binary input signals, and a rectangle indicates an instruction or set of instructions resulting in the performance of a control function.

In FIG. 7A, the operating program within the CPU 132 begins at step 210 with an initialization of the logic and display drive system 130 involving, among other things, an initialization of the outputs of the system, clearing of the microcomputer's RAM and the execution of an initialization or reset routine by the microcomputer. In general, this initialization routine defines and establishes the initial conditions for microcomputer operation including a resetting of its internal logic to an initialized condition from which subsequent operation may proceed. In addition, a message is presented on the LCD display 122 indicating to the user to insert a new pack of cigarettes into the dispenser's case 112 and to close its lid 114. The program then executes a SET-UP STATE subroutine at step 204 wherein the user's smoking habits over a predetermined time interval are determined and stored in memory. Closure of the lid causes the program to proceed to a DEFAULT STATE at step 220 wherein various messages are presented on the LCD display 122 indicating to the user the various operating modes which the system can proceed to from the default state. One routine involves the detection of low power output from the rechargeable batteries 148 at step 280. If it is determined that the rechargeable batteries 148 lack a sufficient charge for proper operation of the programmable cigarette dispenser, the program branches back to the initialize state at step 210 following a recharging of the rechargeable batteries.

Once the program is in the DEFAULT STATE, the program continuously monitors the position of the cigarette dispenser's lid as well as whether the URGE or SELECT selector have been engaged. These three status monitoring procedures are executed simultaneously and in parallel. Thus, from the default state at step 220, one branch of the operating program proceeds to a LID OPEN DETECT subroutine at 290 while another branch of the program proceeds to a SMOKING URGE MODE at step 230 and another branch of the program proceeds to the SELECT MODE at step 330. The program executes the SMOKING URGE MODE subroutine following selection of the URGE switch 226 and then executes a CIGARETTE COUNTDOWN subroutine at step 240 during which a software timing routine counts a predetermined period after which user access to the cigarettes within the dispenser is authorized. If this predetermined countdown period expires without the cigarette dispenser's lid being opened, the program proceeds to an AUTHORIZED ACCESS mode 250 during which the user is authorized to remove a cigarette from the dispenser without an audio or visual alarm being provided to indicate an unauthorized access. If during this authorized access, the lid is not opened, the program proceeds to a SKIP DETECTION routine at step 260 where, among other things, the program records a successful use of the cigarette dispenser, the election by the user not to remove a cigarette from the dispenser, the number of times the user cheated, the number of successful uses of the cigarette dispenser, the time since the last cigarette, excess cigarette use, initial and current rates of smoking, etc., and increases the next countdown period following the next engagement of the URGE selector 126 as described below. Following execution of these various bookkeeping functions during the SKIP DETECTION subroutine at step 260, the program at step 270 returns to the default state to await the next selection of the URGE switch 126 for the occurrence of an unauthorized cigarette access. If the lid is opened prior to expiration of the predetermined countdown period as determined in the cigarette countdown subroutine at step 240 and if the lid remains open for a period longer than authorized as determined during the grace period subroutine at step 247, detection of the lid being open at step 248 causes the program to proceed to a cheat state at step 300 indicating that the smoker has used the programmable cigarette dispenser in an unauthorized manner and has not conformed his smoking behavior to a predetermined set of characteristics stored in the RAM 134 of the logic system 130. During the cheat state, the program decrements the interval time between cigarettes, or the cigarette countdown, as a function of the user's smoking rate as described below. From the CHEAT STATE, the program proceeds to a SMOKING STATE at step 310 wherein the system is responsive to user selection of the URGE switch 126 prior to each puff of a cigarette in order to provide visual and audio signals to the user to encourage him to skip that puff or to, at least, reduce the length of each individual puff of the cigarette.

This is accomplished by means of a PUFF COUNTDOWN subroutine at step 320 executed following the SMOKING STATE in order to encourage the user to inhale reduced amounts of smoke using various reinforcing techniques as described below. Following execution of the PUFF COUNTDOWN subroutines at step 320 and after the cigarette is extinguished, the program returns to the DEFAULT STATE at step 270 and awaits the user's next urge to smoke and continuously monitors for an unauthorized opening of the dispenser's lid.

From the DEFAULT STATE at step 220, the program may, in response to selection of the URGE and MODE switches 126, 128, proceed to a SELECT MODE subroutine at step 330 which is intended primarily for permitting the user to program, or set up, the operation of the programmable cigarette dispenser as desired. This mode allows the user to select various audio and visual signals to be provided at various states of his decision making process in selecting and puffing on a cigarette. Actual programming of the cigarette dispenser is accomplished by means of a PROGRAMMING MODE subroutine at step 340 which is entered following selection of the URGE and MODE switches 126, 128 in a predetermined sequence described below. The operating program stored within the ROM 136 which controls the operation of the CPU 132 is responsive to the various programming inputs provided by a user for adapting the programmable cigarette dispenser to the unique smoking topography and name or term of endearment of an individual user. While the operating program stored within the ROM 136 of the logic and display drive system 130 has thus far been described in rather general terms, the following paragraphs provide greater detail with regard to the various operations which take place in various of the aforementioned subroutines shown in FIG. 7A.

Figure 7B:
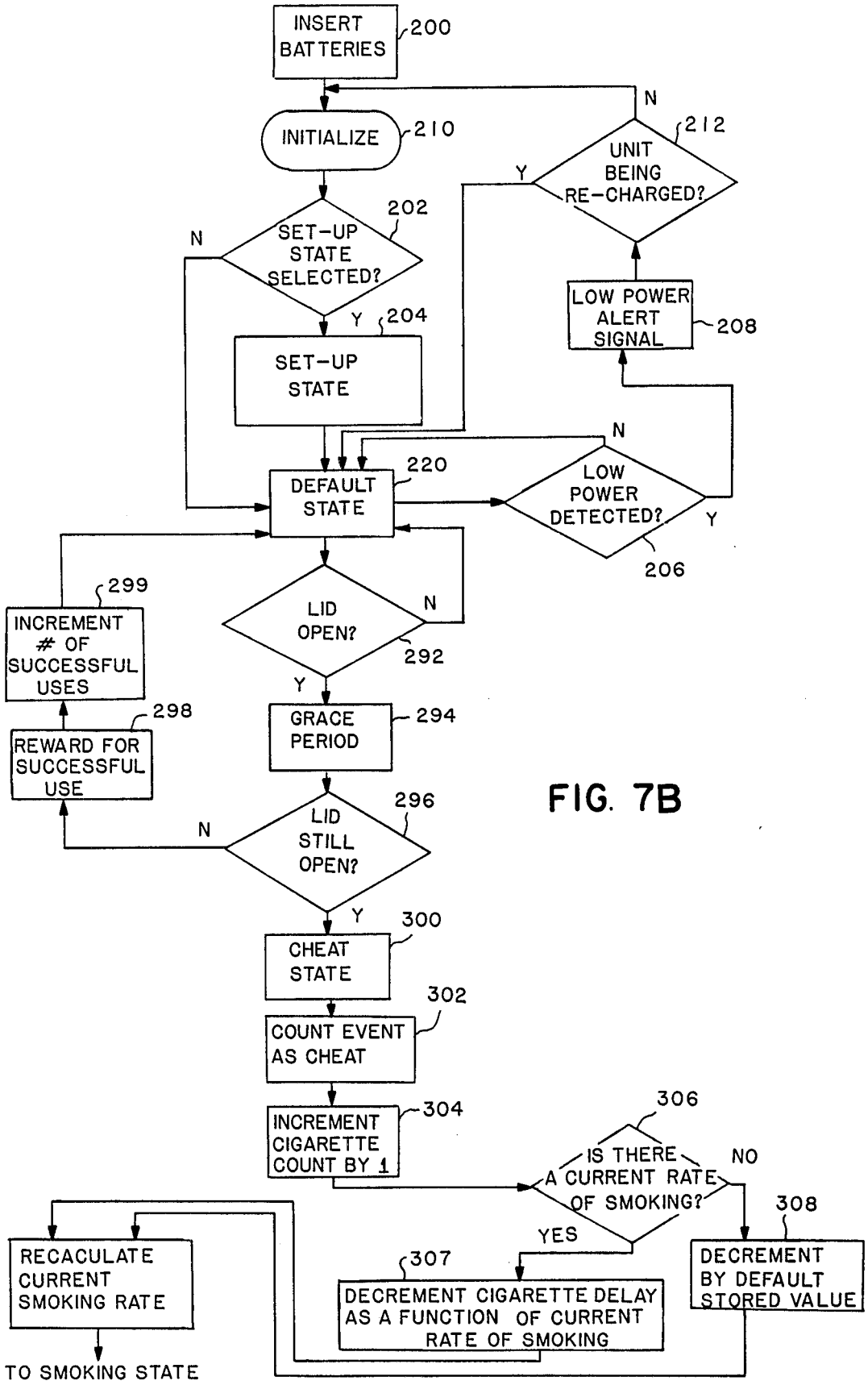

Referring to FIG. 7B, there is shown a flow chart representing the operation of the programmable cigarette dispenser during its initial set-up period and following the detection of an unauthorized opening of the dispenser's lid. Operation of the programmable cigarette dispenser 110 begins with insertion of the rechargeable batteries 148 within its case 112 at step 200. From there the program proceeds to an INITIALIZATION subroutine at step 210 as described above. The program then determines if the SET-UP STATE has been selected at step 202 and, if selected, proceeds to the SET-UP STATE at step 204. In the SET-UP STATE the programmable cigarette dispenser performs a passive function in monitoring and recording the smoker's use of the programmable cigarette dispenser for a predetermined period. During this period, which typically is set for the first three days of cigarette dispenser use, a baseline rate of use of the cigarette dispenser is determined and stored within the system's RAM 134 for establishing the initial operating delays and intervals which are later used in attempting to regulate the user's smoking behavior. This baseline information provides the cigarette dispenser with information regarding the user's smoking habits with which his subsequent performance may be compared for determining whether he has been successful or unsuccessful in controlling his urge to smoke. Following this initial baseline period, the program proceeds to the DEFAULT STATE at step 220 which has as its primary purpose to discourage the user from removing cigarettes from the dispenser and includes the arming of the CHEAT STATE.

From the DEFAULT STATE the program proceeds to a LOW POWER DETECTED subroutine at step 206. If a low power state is detected, the program proceeds to a LOW POWER ALERT SIGNAL subroutine at step 208 for providing the user with visual and/or audio signals indicating that the supply batteries are in need of recharging. The program then determines at step 212 whether the supply batteries are being recharged and, if they are not being recharged and if the RAM has been erased, proceeds to the initialization state at step 210 after the batteries have been fully recharged. If at step 212 it is determined that the supply batteries are being recharged, the program returns to the DEFAULT STATE at 220 following full charging of the batteries. Similarly, if at step 206 it is determined that the rechargeable batteries are outputting a normal supply voltage, the program returns to the DEFAULT STATE for execution of this subroutine.

The first step in the DEFAULT STATE involves the determination of whether the lid is open at step 292. If the lid is determined not to be open, the program returns to the DEFAULT STATE and continues in this loop until a lid opening is detected. Following detection of a lid opening at step 292, a GRACE PERIOD is provided at step 294 for allowing the user to open the lid for a short, predetermined time interval, e.g., two seconds, without counting the lid opening as an unauthorized usage. The purpose of this grace period is to provide the user with a final opportunity to reconsider his giving in to the urge to smoke. At this time an appropriate audio/visual signal is provided for discouraging the user from withdrawing a cigarette from the dispenser and for closing the lid within the grace period. Following expiration of the grace period, the program next determines if the lid is still open at step 296 and, if it is determined that the lid has been closed within the grace period, the program proceeds to step 298 and provides reinforcement in the form of appropriate visual and audio messages to encourage the user in his successful resistance to the urge to smoke. The program then counts this use of the cigarette dispenser as a successful use and increments the number of successful uses for storage in the RAM 134 and subsequent recall and display upon the LCD display 122.

If at step 296 it is determined that the lid is still open after the grace period, the program enters a CHEAT STATE at step 300 which involves counting the event as an unauthorized usage, or cheating occurrence, at step 302 and increments the cigarette use count by 1 at step 304 and recalculates the current smoking rate, and decrements the countdown delay for the next cigarette.

In addition, the program decrements the interval time as a function of the user's smoking rate in order to provide a time delay between the onset of the urge to smoke and the time at which the dispenser may be opened to withdraw a cigarette with the user can handle. Thus, once the grace period is over and the lid is not closed, the smoker is reminded to close the lid with an alarm signal and is encouraged to activate the URGE selector 126 each time he has an urge to inhale and to wait out progressively longer delays, e.g., increments of fifteen seconds, for each subsequent urge to puff. The smoker is further encouraged to extinguish a cigarette after the third puff or two minutes with a number of puffs and the time since removal of the cigarette stored in RAM 134 for subsequent use. An excessive puff rate or cigarette use results in a visual message appearing on the LCD display 122. After the interval time is decremented following unsuccessful use of the cigarette dispenser at step 305, the program then determines if there is a current rate of smoking stored in the RAM 134 at step 306. If it is determined at step 306 that there is a current rate of smoking, the access delay following selection of the URGE switch 126 is decremented as a function of the current rate of smoking and the program proceeds to the SMOKING STATE. If at step 306 it is determined that there is no current rate of smoking stored in the RAM 134, the program decrements the default delay value which is stored in the logic and display drive system's ROM 136 at the time of manufacture of the programmable cigarette dispenser. The program then proceeds to the SMOKING STATE.

Figure 7C:
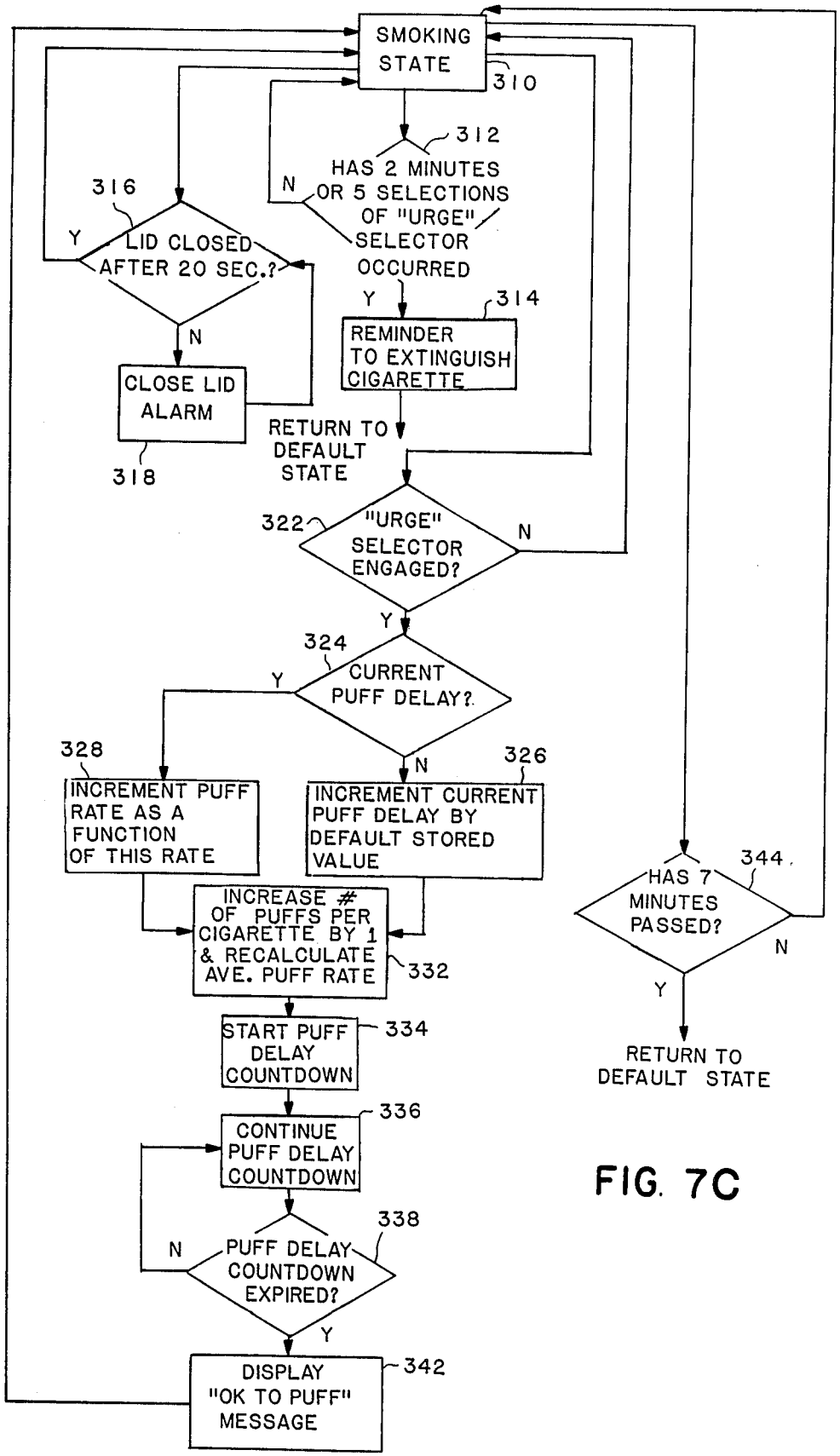

Referring to FIG. 7C, there is shown sequence of operations which occur in the SMOKING STATE following the opening of the cigarette dispenser's lid and the removal of a cigarette therefrom. In the SMOKING STATE, the program executes a lid closure detection subroutine which involves determining whether the lid is closed within twenty seconds after it is opened at step 316. If it is determined that the lid is open beyond the twenty second interval, the smoker is given an audio and/or visual alarm signal at step 318 in order to alert the smoker to the fact that the lid is open beyond the twenty second prescribed time interval, and the program loops back to step 316 and again checks to see if the lid has been closed. Once the lid has been closed, the program loops from step 316 back to the smoking state at step 310 for executing the various operations in this state.

Once a cigarette has been removed from the programmable cigarette dispenser, the program recalculates the current rate of smoking and stores the current time in the RAM 134. The program then counts for two minutes following expiration of this time period. This seven minute time interval is provided in order to encourage the user to take fewer puffs and to extinguish the cigarette earlier than he normally would by providing appropriate aural/visual indications that this seven minute interval has expired.

From the smoking state at step 310, the program proceeds at step 322 if the URGE selector 126 has been engaged. If the URGE selector has been engaged, the program proceeds to step 324 and determines if a current puff delay is stored within the system's RAM 134. If a current puff delay is available, the program proceeds to step 328 for the purpose of incrementing the puff rate as a function of the current puff rate. For example, once a cigarette has been withdrawn from the cigarette dispenser, each engagement of the URGE selector represents a puff of the cigarette. In response to each engagement of the URGE selector, the program stored within the ROM 136 increments the puff rate following each engagement of the URGE selector. For example, following initial engagement of the URGE selector after removal of a cigarette, the programmed wait for a puff may be set at fifteen seconds, while after the second engagement of the URGE selector, the wait to take a puff interval may be incremented to thirty seconds. Following the incrementing of the puff rate at step 328, the program proceeds to step 332 for increasing the number of puffs per cigarette by one and recalculating the average puff rate. If at step 324 it is determined that a current puff rate is not available, the program increments the current puff delay by a pre-programmed default increment stored within the ROM 136. Following the increasing of the number of puffs per cigarette by one at step 332, the program initiates the puff delay countdown at step 334 and continues the puff delay countdown at step 336 until this time interval has expired as determined at step 338. Once the puff delay countdown has expired, the user is informed by appropriate aural and/or visual signals that he is now authorized to take a puff of the cigarette removed from the programmable cigarette dispenser and encouraged by audio/visual messages to inhale less deeply and for a short duration only. Once the user has been alerted that he is now authorized to take a puff of the cigarette at step 342, the program returns to the beginning of the smoking state subroutine at step 310 and continues this cycle each time the URGE selector 126 is engaged.

Figure 7D:
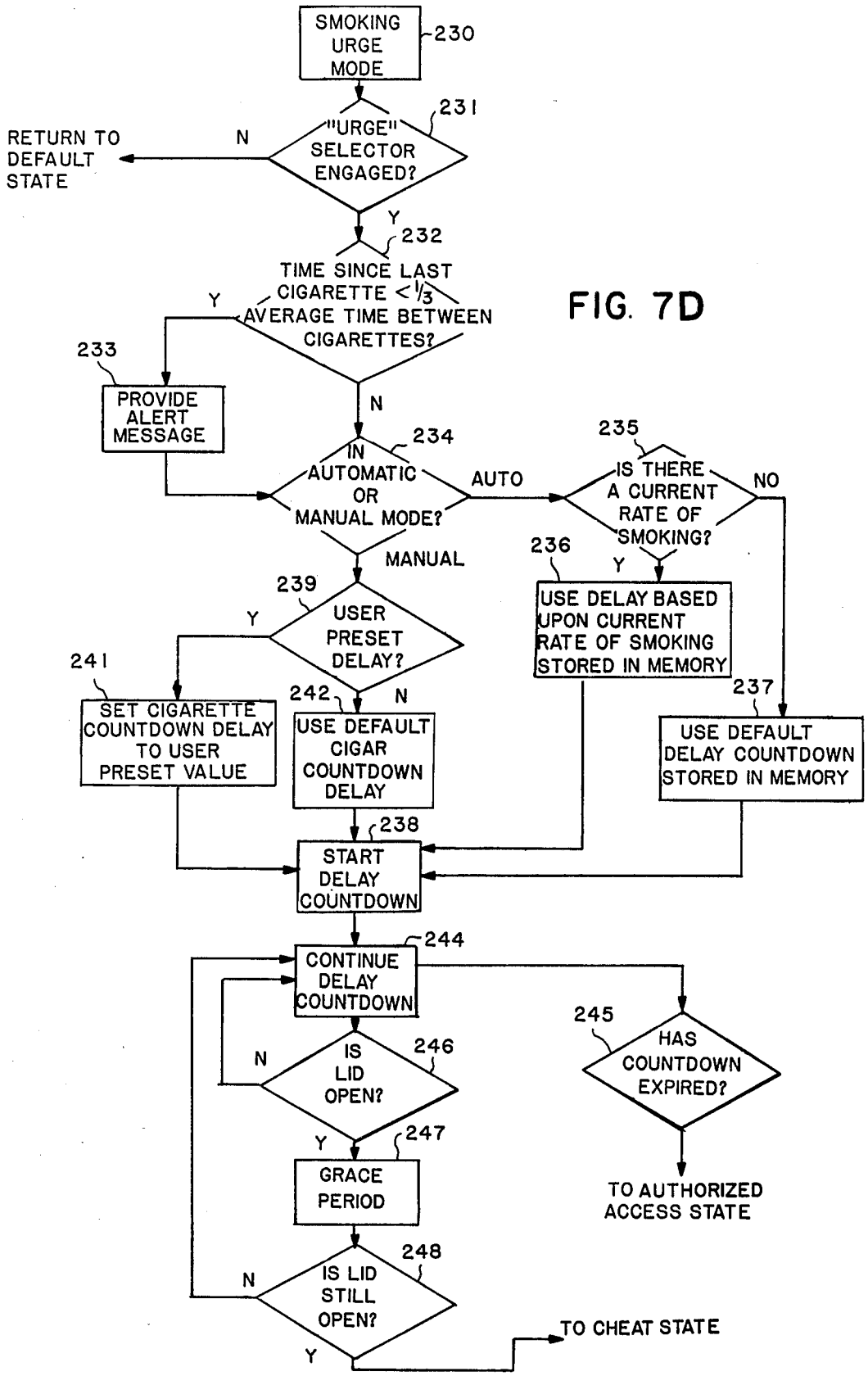

Referring to FIG. 7D, there is shown a flow chart representing the operations involved in the SMOKING URGE MODE which begins at step 230. The program initially detects selection of the URGE switch at step 231 and, if engagement of the selector is detected, proceeds to step 232 where the program determines if the time since the last selection of a cigarette is less than the average interval between cigarettes at step 232. If the time since the last cigarette is less than the average interval between the cigarettes, the program branches to step 233 and provides an alert message indicating an excessive rate of cigarette usage by the smoker. If at step 232 it is determined that the time since the last cigarette selected exceeds one-third the average interval between cigarettes, the program proceeds to step 234 and determines if either automatic or manual mode has been selected by the user. If in the automatic mode, the program branches to step 235 and determines if there is a current rate of cigarette smoking stored in the system's RAM 134. If a current rate of smoking is stored in the RAM, the program branches to step 236 and makes use of this current rate of smoking in initiating the start delay countdown at step 238. If at step 235 it is determined that there is no current rate of smoking stored in the RAM 134, the program branches to step 237 and recalls a pre-programmed default delay countdown stored in the ROM 136 and then proceeds to initiate start of the delay countdown at step 238 in accordance with this predetermined default delay countdown value.

If at step 234 it is determined that the manual mode has been selected by the user, the program branches to step 239 and determines if the user has input a preset delay in the programmable cigarette dispenser. If the user has input a preset cigarette countdown delay, this value is recalled at step 241 and used to initiate start of the delay countdown at step 238. On the other hand, if the user has not entered a preset delay, a use default cigarette countdown delay is recalled from the ROM 136 at step 242 and is utilized by the CPU to initiate start of the countdown delay at step 238. The smoking delay countdown continues at step 244 until its expiration is detected at step 245 whereupon the program branches to the AUTHORIZED ACCESS STATE. The countdown delay continues with the program continually monitoring the lid status at step 246 and introducing a GRACE PERIOD at step 247 following lid opening. This grace period is intended to provide the user with a final opportunity to overcome his urge to smoke and to decline from removing a cigarette from the cigarette dispenser. The program continually monitors the status of the lid and branches back to the continue delay countdown subroutine at step 244 once the lid is closed. If the lid remains open beyond the grace period as established at step 247, the program branches from step 248 to the CHEAT STATE and provides appropriate aural and visual indications to the user that his use of the cigarette dispenser is unauthorized.

Figure 7E:
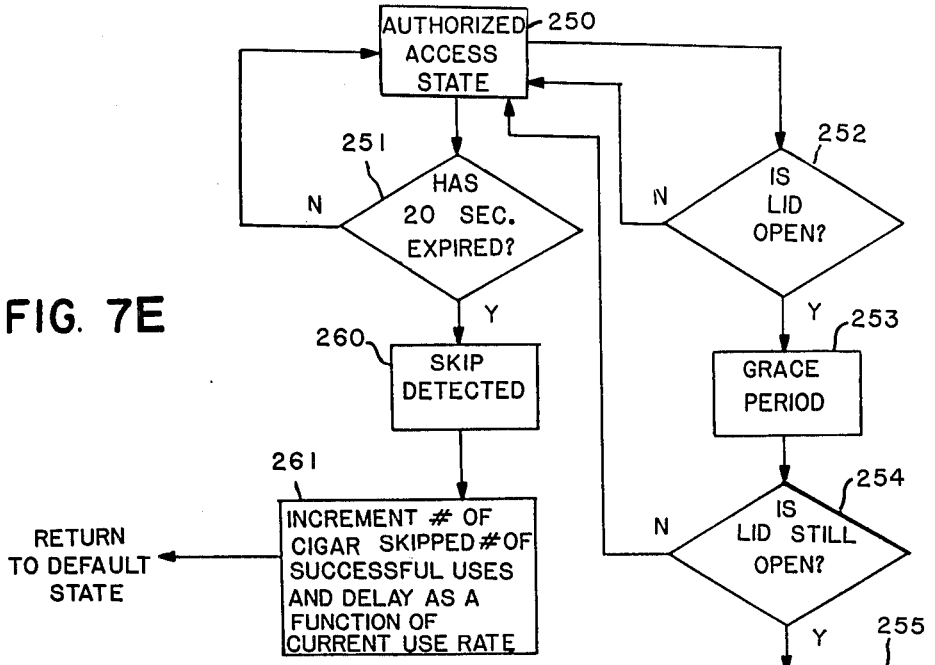

Referring to FIG. 7E, there are shown the operations which occur in the AUTHORIZE ACCESS STATE which occurs when the user has successfully waited out the delay countdown following his urge to smoke a cigarette and his selection of the URGE switch 126. The AUTHORIZED ACCESS STATE subroutine begins at step 250 and checks for the occurrence of two events. One event relates to the closure of the lid where at step 251 the program counts a predetermined time interval, e.g., twenty seconds, during which the user is authorized to open the lid and remove a cigarette from the cigarette dispenser. If at the end of this predetermined time interval, the opening of the lid has not occurred, this is registered as a skip detection at step 260 indicating that the user has not only successfully used the programmable cigarette dispenser, but has completely denied his urge to smoke by refusing to remove a cigarette from the cigarette dispenser. The program then proceeds to step 261 where various bookkeeping operations take place such as an incrementing of the number of cigarettes skipped, an incrementing of the number of successful uses of the programmable cigarette dispenser, and an increase in the interval between authorized cigarette access as a function of the user's current smoking rate. These various parameters are stored in the system's RAM 134 for subsequent recall and use by the CPU 132.

In the AUTHORIZED ACCESS STATE 250, the program also determines if the lid has been opened at step 252 and provides a grace period at step 253 following the opening of the lid in order to provide the user with a final opportunity, even after he has opened the cigarette dispenser's lid, to reject his initial urge to smoke and and refuse to remove a cigarette from the cigarette dispenser. If the lid is closed prior to the expiration of the grace period as determined at step 254, the program branches back to the AUTHORIZED ACCESS STATE at step 250 and increments the various aforementioned parameters as previously described. If at step 254 it is determined that the lid is open beyond the grace period, the program branches to step 255 and performs various bookkeeping functions such as incrementing the number of cigarettes smoked by one at step 255, incrementing the delay between authorized cigarette access as a function of the user's smoking rate at step 256, recalculating the current rate of smoking, incrementing the number of successful uses of the programmable cigarette dispenser at step 257, and incrementing the number of authorized uses of the programmable cigarette dispenser at step 258. These various numbers are generated by the CPU 132 which provides these updated numbers to the RAM 134 for storage therein and subsequent use.

Figure 7F:
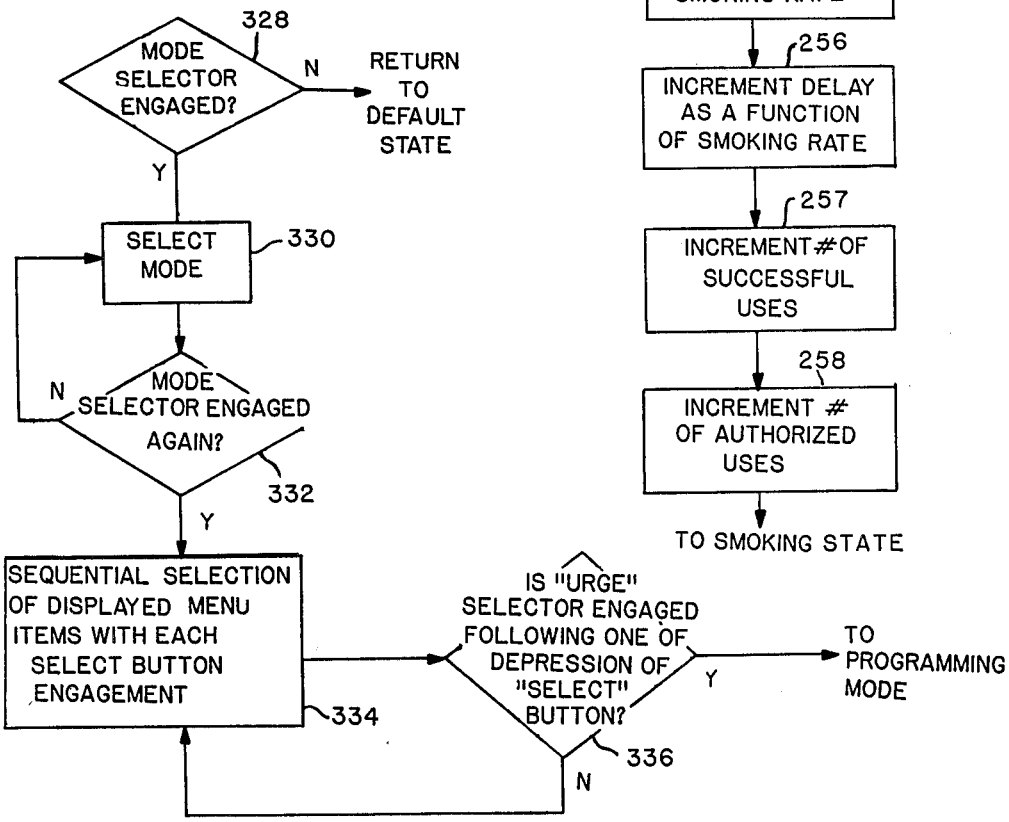

Referring to FIG. 7F, there is shown the sequence of operations involved in the SELECT MODE of operation of the programmable cigarette dispenser. The SELECT MODE of operation represents the user interactive state of the programmable cigarette dispenser and permits the user to enter data into the programmable cigarette dispenser by the selective actuation of the URGE and MODE selectors 126, 128. The select mode is initiated by engagement of the MODE selector 128 at step 328. With the MODE selector engaged, the program proceeds to the SELECT MODE of operation at step 330 and awaits a second engagement of the MODE selector at step 332. Following the second engagement of the MODE selector, the program proceeds to step 334 and looks for the sequential selection of the URGE and SELECT switches at steps 334 and 336. For example, the selection of the URGE selector following second engagement of the MODE selector, permits the user to enter into the system's RAM 134 such data as: selection of the set-up mode of operation; automatic/-manual operation of the cigarette dispenser; instructions to permit the programmable cigarette dispenser to communicate with a host computer coupled thereto; to change the pack of cigarettes in the programmable cigarette dispenser; to display personalized information on the video display; to advance or retard the delay for cigarette waiting; to set the puff delay; and to recharge the storage batteries. The change pack mode of operation involves the system counting the number of cigarettes withdrawn from the dispenser by the user and permits the user to change the pack of cigarettes between the 10th and 20th cigarettes used without recording an unauthorized opening of the cigarette dispenser. This data is then recalled from the RAM 134 by the CPU 132 during subsequent operation of the programmable cigarette dispenser which permits its operation to be uniquely tailored to the individual smoking habits of the user. Once the URGE selector has been engaged as determined at step 336, the program proceeds to a PROGRAM MODE wherein the user may pre-program the cigarette dispenser in accordance with his individual smoking characteristics.

The operating parameters of the programmable cigarette dispenser may, of course, be established on the basis of individual user smoking habits. Typical values for various of these parameters would be as follows: 15 seconds for the default puff delay interval which would be increased by 15 seconds for each URGE selector engagement; a grace period of 2 seconds with a 1 minute warning audio signal after taking out a cigarette; a 20 second lid warning interval for sounding an alarm if the lid is not closed after the expiration of this interval; an initial cigarette default delay of 30 seconds to be increased by 4 seconds when the cigarette is skipped, to be increased for 2 seconds for an authorized cigarette usage, and to be decreased by 1 second for a user cheat occurrence, with a minimum delay of 10 seconds and a maximum delay of 45 minutes; with an initial allowable daily cigarette rate calculated by dividing cigarette usage over a 72 hour period by 3.

There has thus been shown a cigarette dispenser which provides authorized user access to cigarettes therein only after a predetermined time interval following the user's initial decision to smoke a cigarette. This predetermined interval, the length of which may be selected by the user, provides the user with an opportunity to reconsider and reject the next cigarette. During this period various information is provided to the user by the cigarette dispenser to discourage him from satisfying his urge to smoke.

While particular embodiments of the present invention have been shown and described, it will be obvious to those skilled in the art that changes and modifications may be made without departing from the invention in its broader aspects. For example, while the present invention is disclosed in terms of its use in a cigarette dispenser, it has application in any container wherein is stored a substance where one desires to use the substance in a controlled manner, to reduce his or her use of the substance, or to eventually abstain from use of the substance in a situation where use of the substance is never totally denied. Furthermore, while the present invention is disclosed in terms of interfering with the immediate gratification of the smoking urge, it has application in interfering with the gratification of other undesirable habits. In addition, the present invention has application in any situation wherein it is desirable to provide behavioral stimulation for interfering with other forms of undesirable, irrational impulses or urges. In this manner, the present invention may be used as an aid in the making of rational choices in the face of irrational impulses by an individual. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a container having a displaceable cover and holding a substance, wherein said cover may be opened by a user of said container who is motivated by impulses to gain access to said substance, apparatus for controlling the behavior of said user in terms of gaining access to said substance following the occurrence of said impulses, said apparatus comprising first means coupled to the container's cover and responsive to the displacement of the cover by the user for recording an initial behavioral pattern of user access to the substance over a time period of predetermined length;

second means coupled to the container's cover and to said first means for determining the current bdhavioral pattern of user access to the substance and for comparing said current behavioral pattern with said initial behavioral pattern; and third means coupled to said second means and responsive to the comparison of said current and initial behavioral patterns for providing positive reinforcement to said user when said current behavioral pattern reflects reduced access by thr user to the substance when compared to said initial behavioral pattern and for providing negative reinforcement to said user when said current behavioral pattern reflects increased access by the user to the substance when compared to said initial behavioral pattern.

2. Apparatus responsive to user inputs for controlling the behavior of a user by means of psychological principles, wherein the user's behavior is characterized by desirable action and by undesirable action and wherein said undesirable action is motivated by impulses, said apparatus comprising:

first means responsive to inputs of the user for recording an initial behavioral pattern of the user including both desirable and undesirable actions;

second means responsive to inputs of the user for determining a current behavioral pattern of the user;

third means coupled to said first and second means for comparing said initial and current behavioral patterns of the user; and fourth means coupled to said third means for providing positive reinforcement for the user when said current behavioral pattern includes increased occurrences of said desirable action and reduced occurrences of said undesirable action and negative reinforcement for the user when said current behavioral pattern includes decreased occurrences of said desirable action and increased occurrences of said undesirable action as compared to the occurrences of said desirable and undesirable action in said initial behavioral pattern.

3. The apparatus of claim 2 wherein said apparatus includes a container having a displaceable cover and holding a substance and wherein said cover may be opened by the user of said container who is motivated by impulses to gain access to said substance, with said apparatus controlling the user's behavior in terms of the extent the user grains access to said substance, wherein said first means is coupled to the container's cover and responsive to the displacement of the cover by the user for recording user access to said substance over a time period of predetermined length in establishing said initial behavioral pattern with said second means coupled to the container's cover and responsive to the displacement of the cover by the user for determining user access to said substance during said current behavioral pattern and wherein said third means compares user access to said substance during said time period of predetermined length with said current behavioral pattern, with said fourth means providing positive reinforcement for the user when said current behavioral pattern reflects reduced access by the user to said substance and negative reinforcement for the user when said current behavioral pattern reflects increased access by the user to said substance when compared to said initial behavioral pattern over said time period of predetermined length.

4. The apparatus of claim 3 further including a user responsive selector engaged by the user following an initial impulse to gain access to said substance and said second means includes first timing means actuated by a first engagement of said selector for establishing a first time interval of predetermined length in accordance with said initial behavior pattern of user access wherein positive reinforcement is provided if said first time interval expires before the cover is opened by the user and negative reinforcement is provided if said first time interval does not expire before the cover is opened by the user.

5. The apparatus of claim 4 further including second timing means for incrementing said first time interval each time the user waits said first time interval before opening the container cover following the initial impulse to gain access to said substance and for decrementing said first time interval each time the user does not wait said first time interval before opening the container cover following the initial impulse to gain access to said substance.

6. The apparatus of claim 5 wherein said fourth means includes an audio signal generator for providing positive aural reinforcement when the user waits said first time interval before opening the container cover and negative aural reinforcement when the user does not wait said first time interval before opening the container cover following the initial impulse to gain access to said substance.

7. The apparatus of claim 5 wherein said fourth means includes a video display for providing positive visual reinforcement when the user waits said first time interval before opening the container cover and negative visual reinforcement when the user does not wait said first time interval before opening the container cover following the initial impulse to gain access to said substance.

8. The apparatus of claim 5 further including third timer means responsive to a second and subsequent engagements of said selector following the opening of the container cover by the user and an initial urge to use the substance removed from the container for establishing a second time interval, wherein use of the substance is authorized following expiration of said second time interval.

9. The apparatus of claim 8 wherein said fourth timer means increments said second time interval by a predetermined amount following the second and each subsequent engagement of the selector for incrementally increasing the time interval following which use of the substance is authorized.

10. The apparatus of claim 9 wherein the predetermined amount by which said second time interval is incremented is a function of the rate of said second and subsequent engagements of said selector by the user.

11. The apparatus of claim 9 wherein the predetermined amount by which said second time interval is incremented is a function of the rate of said first engagement of said selector by the user.

12. The apparatus of claim 8 further including video display means coupled to said third timer means for providing a visual indication to the user when said second time interval has expired and use of the substance is authorized.

13. The apparatus of claim 8 further including audio means coupled to said third timer means for providing an aural indication to the user when said second time interval has expired and use of the substance is authorized.

14. The apparatus of claim 8 further including fifth timer means coupled to the container cover for establishing a third time interval following the opening of the container cover and for providing an indication to the user to discontinue use of the substance following said third time interval.

15. The apparatus of claim 14 further including video display means coupled to said fifth timer means for providing visual indication to the user of the expiration of said third time interval following the opening of the container cover and to discontinue use of the substance.

16. The apparatus of claim 14 further including audio means coupled to said fifth timer means for providing an aural indication to the user of the expiration of said third time interval following the opening of the container cover and to discontinue use of the substance.

17. The apparatus of claim 8 further including sensing means coupled to said selector for detecting and counting a predetermined number of engagements of said selector following the opening of said container cover and for providing an indication to the user to discontinue use of the substance following said predetermined number of engagements of said selector by the user.

18. The apparatus of claim 14 further including counting means for recording the number of times the user waits for the expiration of said first time interval as well as the number of times the user does not wait for the expiration of said first time interval before opening the container cover.

19. The apparatus of claim 18 further including video display means coupled to said counting means for providing a visual indication to the user of the number of times the container cover was opened following the expiration of said first time interval as well as the number of times the container cover was opened prior to the expiration of the said first time interval.

20. The apparatus of claim 18 further including audio alarm means coupled to said counting means for providing an aural indication to the user of the number of times the container cover was opened following the expiration of said first time interval as well as the number of times the container cover was opened prior to the expiration of the said first time interval.

21. The apparatus of claim 18 wherein said counting means further records the number of times the container cover is not opened following expiration of said first time interval.

22. The apparatus of claim 21 further including video display means coupled to said counting means for providing a visual indication to the user of the number of times the container cover is not opened following expiration of said first time interval.

23. The apparatus of claim 21 further including audio alarm means coupled to said counting means for providing an aural indication to the user of the number of times the container cover is not opened following expiration of said first time interval.

24. The apparatus of claim 18 further including fifth timer means coupled to said container cover for establishing a fourth time interval of short duration wherein the opening of the container cover is not recorded if the container cover is closed prior to expiration of said fourth time interval.

25. The apparatus of claim 24 further including video display means coupled to said container cover and to said fifth timer means for providing the user with a visual indication of the number of times the container cover is closed prior to expiration of said fourth time interval.

26. The apparatus of claim 24 further including audio alarm means coupled to said container cover and to said fifth timer means for providing the user with an aural indication of the number of times the container cover remains open following expiration of said fourth time interval.

27. The apparatus of claim 2 wherein said fourth means includes video display means and audio means for providing said positive and negative reinforcement to the user in the form of visual and aural messages, respectively.

28. The apparatus of claim 27 further including user responsive programming means for selecting said visual and aural messages.

29. The apparatus of claim 28 wherein said video display means and said audio means provide programming information to the user regarding the operation of said programming means in selecting said visual and aural messages.

30. The apparatus of claim 24 further including user responsive manual input means for allowing the user to manually select the furation of said first, second, third and fourth time intervals.

31. The apparatus of claim 3 further including counting means coupled to the container's cover for counting the number of times said cover is opened and for allowing said cover to be opened following a predetermined number of cover openings without providing either positive or negative reinforcement for the user to permit additional amounts of said substance to be placed within the container.

32. The apparatus of claim 31 wherein said counting means further counts the number of times additional amounts of said substance are placed within the container.

33. The apparatus of claim 24 further including sixth timer means coupled to said container cover for establishing a fifth time interval following an opening of said cover for providing an indication to the user to close said cover following expiration of said fifth time interval.

34. The apparatus of claim 33 further including video display means coupled to said sixth timer means for providing a visual indication to the user to close said cover following the expiration of said fifth time interval.

35. The apparatus of claim 33 further including audio alarm means coupled to said sixth timer means for providing an aural indication to the user to close said cover following the expiration of said fifth time interval.

36. The apparatus of claim 24 wherein said counting means further records the total number of times the container cover is opened.

37. The apparatus of claim 36 further including video display means coupled to said counting means for providing a visual indication to the user of the total number of times the container cover is opened.

38. The apparatus of claim 36 further including audio alarm means coupled to said counting means for providing an aural indication to the user of the total number of times the container cover is opened.

39. The apparatus of claim 36 further including video display means for providing the user with a video presentation of all of said time intervals as well as of the extent of use of said container in response to engagement of said selector.

40. The apparatus of claim 36 further including audio alarm means for providing the user with an aural indication of all of said time intervals as well as of the extent of use of said container in response to engagement of said selector.

41. The apparatus of claim 3 wherein said container includes rechargeable storage batteries for energizing said apparatus.

42. The apparatus of claim 3 wherein said apparatus includes a microcomputer, a random access memory and a read only memory.

43. The apparatus of claim 42 wherein said microcomputer is coupled to an external host computer for the transfer of data therebetween.

* * * * *